United States Patent [19]

Fukumoto et al.

[11] Patent Number: 4,673,631

[45] Date of Patent: Jun. 16, 1987

[54] TONER, CHARGE-IMPARTING MATERIAL AND COMPOSITION CONTAINING METAL COMPLEX

[75] Inventors: Hiroshi Fukumoto, Kawasaki; Katsuhiko Tanaka, Tokyo; Yoji Kawagishi, Yawata, all of Japan

[73] Assignee: Canon Kabushiki Kaisha, Tokyo, Japan

[21] Appl. No.: 808,508

[22] Filed: Dec. 13, 1985

[30] Foreign Application Priority Data

| | | | |
|---|---|---|---|
| Dec. 15, 1984 | [JP] | Japan | 59-264756 |
| Dec. 15, 1984 | [JP] | Japan | 59-264757 |
| Jan. 12, 1985 | [JP] | Japan | 60-3737 |
| Jan. 12, 1985 | [JP] | Japan | 60-3738 |
| Jan. 12, 1985 | [JP] | Japan | 60-3739 |
| Jan. 25, 1985 | [JP] | Japan | 60-10928 |
| Jan. 26, 1985 | [JP] | Japan | 60-13121 |
| Jan. 26, 1985 | [JP] | Japan | 60-13122 |

[51] Int. Cl.[4] ..... G03G 9/08

[52] U.S. Cl. ..... 430/110; 524/204; 524/238; 430/115; 556/132; 556/148

[58] Field of Search ..... 430/110; 524/238, 204

[56] References Cited

U.S. PATENT DOCUMENTS

| | | | |
|---|---|---|---|
| 2,892,794 | 6/1959 | Insalaco . | |
| 3,826,747 | 7/1974 | Nagashima et al. | 430/110 X |
| 3,844,966 | 10/1974 | Nelson | 430/115 |
| 4,206,064 | 6/1980 | Kiuchi et al. | 430/106 |
| 4,425,280 | 1/1984 | Ho | 556/134 |

*Primary Examiner*—J. David Welsh

*Attorney, Agent, or Firm*—Fitzpatrick, Cella, Harper & Scinto

[57] ABSTRACT

A triboelectrically chargeable composition for use in development of electrostatic latent images. The composition contains a metal complex of an amino acid compound having an amino or mono-substituted amino group and a carboxylic group. The composition is embodied typically as a positively chargeable toner and also as a charge-imparting material for charging a toner.

31 Claims, 1 Drawing Figure

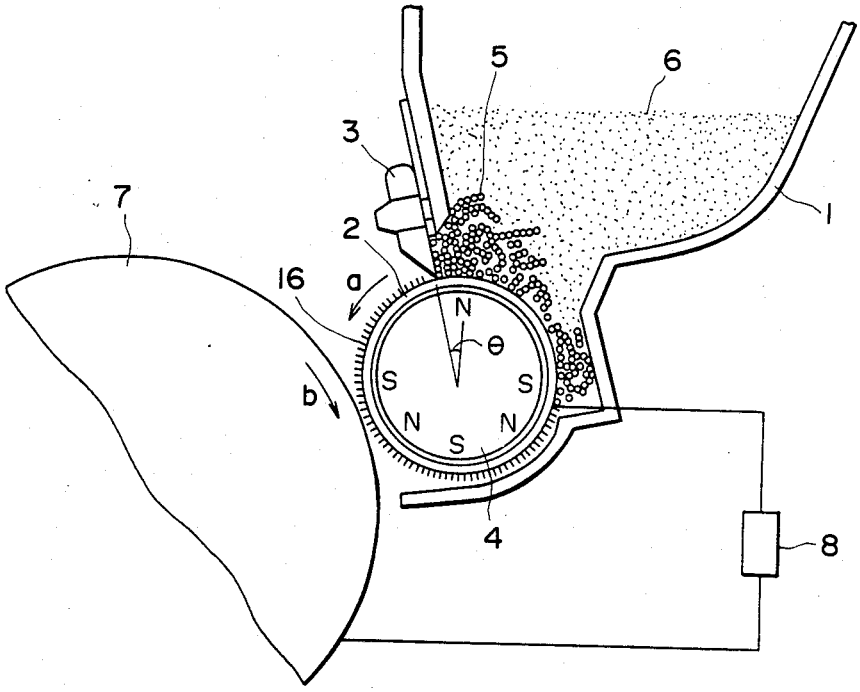
5
6
3
7
2
1
16
a
N
θ
S
S
b
N
N
S
4
8

TONER, CHARGE-IMPARTING MATERIAL AND COMPOSITION CONTAINING METAL COMPLEX

FIELD OF THE INVENTION AND RELATED ART

The present invention relates to a toner used in a developer for developing electrostatic images in electrophotography, electostatic recording and electrostatic printing, more particularly to a toner for developing electrostatically charged images containing a specific organic metal complex, which is uniformly and strongly charged positively to visualize negatively charged electrostatic image or visualize positively charged electrostatic image through reversal development, thereby providing high-quality images.

Further, the present invention relates to an electric charge-imparting material for imparting triboelectric charge to a developer containing a specific organic metal complex for developing electrostatic images in electrophotography, electrostatic recording and electrostatic printing.

Furthermore, the present invention relates to a triboelectrically chargeable composition containing a specific organic metal complex for use in development of electrostatic images to form a visible image in electrophotography, electrostatic recording and electrostatic printing.

Hitherto, a large number of electrophotographic processes have been known, as disclosed in U.S. Pat. Nos. 2,297,691; 4,071,361, and others. Generally speaking, photoconductive materials are utilized in these processes, and the steps included therein comprise forming electrical latent images on photosensitive members by various means, then developing the latent images by using developing powder (frequently called as "toner"), transferring the toner images thus formed to a recording medium such as paper, as desired, and thereafter fixing the images by heating, pressure or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner for dry development system to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles.

For such a toner for dry-system development, it has been becoming a general practice to use a positive or negative charge controlling agent in order to improve the charging characteristic.

Positive charge controllers conventionally used in toners for dry development system, may include, for example, quaternary ammonium compounds and organic dyes, particularly basic dyes and salts thereof including nigrosine base and nigrosine. These charge controllers are usually added to a thermoplastic resin to be dispersed in the resin while it is molten under heating, and the resultant resin mixture is micropulverized into fine particles and, if desired, adjusted to suitable sizes. The conventional charge controllers have been composed of such coarse particles that 30% by number or less thereof have particle sizes which are 1/5 or smaller of the average particle size of the toner to be used in combination.

However, these conventional charge controllers are liable to cause lowering in the charge controlling characteristic, when subjected to mechanical collision and friction during kneading under heat to change in temperature and humidity conditions.

Accordingly, when a toner containing these charge controllers is used in a copying machine to effect development, the toner can cause deterioration during continual use.

Further, these conventional charge controllers, as represented by nigrosine, show dense colors which provide a serious obstacle to formation of toners in bright chromatic colors.

As another serious disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controler more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner carrying member and also cause lowering in free flowing property of the toner, fog and lowering in image density. Alternatively, for improvement in dispersibility of these dyes into a resin, there is also employed a method in which powder of a charge controller and resin powder are previously mechanically pulverized and mixed before melt-kneading. This method is not competent enough to overcome the original poor dispersibility, and evenness of charging satisfactory in practical application has not yet been obtained.

More specifically, when such a conventional charge controller is used in a toner, uneven or different amounts of charge are provided to individual toner particles through friction between toner particles, toner and carrier particles, or toner and a toner-carrying member such as a sleeve, whereby an undesirable phenomenon such as developing fog, toner scattering or carrier contamination is liable to occur. Such an undesirable phenomenon is pronounced when copying is repeated for a large number of times, thereby to render the toner substantially unsuitable for copying. Further a toner thus obtained has a remarkably lower transfer efficiency under a high humidity condition and is thus unfit for a practical use.

Furthermore, when such a toner containing a conventional charge controller is used for a long time, sticking of toner is promoted due to insufficient charge to result in an undesirable influence to formation of latent images (filming), or an ill effect to a cleaning step in copying operation such as formation of flaws on a photosensitive member or a cleaning member such as a cleaning blade or promotion of wearing of these members.

Thus, the use of conventional charge controllers involves many problems, the dissolution of which is earnestly expected in this technical field. While there have been many proposals for improvement, a charge controller satisfying practical requisites as a whole has not been obtained.

In order to have a toner acquire an electric charge, a method of utilizing only the triboelectric chargeability of the toner per se has been known as described above. In this method, however, the chargeability of the toner is small unless it contains an appropriate charge controller, the image obtained by such a toner is liable to be accompanied with fog and unclear. For this reason, there has been proposed to impart triboelectric charge by a movement or carriageregulating member such as magnetic particles, a carrier, a sleeve or a doctor blade, or a developing material or member for charging. The developing material or member for charging is a material or member for imparting or auxiliarily imparting a triboelectric charge to a toner through contact with the toner.

If such a charge-imparting material having a charge imparting ability is used, the necessity for a toner a contain an additive for controlling the chargeability of the toner, i.e., a charge controller, is minimized, whereby contamination of a carrier or a photosensitive member with the additive is minimized. Therefore, lowering of chargeability or disturbance of latent images during a successive copying operation is minimized, so that even a color toner can readily be charged.

However, in order to provide a good charge-imparting property to a movement-regulating material such as magnetic particles, a carrier, sleeve or doctor blade, or a developing member for charging, it is necessary to use a substance or compound which can provide a strong charge-imparting ability and also can be applied or coated onto the material or can be dispersed in the material. In this regard, the carrier particles are generally used for a long period of time without exchange, and the sleeve is used until the main body of a copier cannot be used, so that they must be mechanically tough and durable for a long period of time. Thus, a good additive for improving a charge-imparting characteristic of such a charge imparting material for supplementing the chargeability of toner is also expected.

SUMMARY OF THE INVENTION

A principal object of the present invention is to provide a new technique for dissolving the above mentioned problems in the field of controlling electric charge of a toner.

Another object of the present invention is to provide a developer which can be provided with a stable amount of and a sharp and uniform distribution of triboelectric charge through friction between toner particles, between toner and carrier or between toner and a toner-carrying member such as a sleeve in case of one-component development system and can be controlled to have a triboelectric charge in an amount adapted to a developing system to be used.

A still further object of the invention is to provide a developer capable of effecting development and transfer faithful to latent images, i.e., a developer capable of realizing a high image density and a good reproducibility of a half tone without causing sticking of the toner to a background region, fog or scattering of the toner in the neighborhood of latent image contour during development.

A further object of the invenion is to provide a developer which retains initial performances without causing agglomeration or change in charging characteristic of the toner even when the developer is continually used for a long time.

A still another object of the invention is to provide a toner which reproduces a stable image not readily be affected by change in temperature and humidity, particularly a developer having a high transfer efficiency without causing scattering or transfer drop-off during transferring under a high humidity or a low humidity.

A further object of the invention is to provide a developer with excellent storage stability which can retain initial characteristics even after a long period of storage.

A further object of the invention is to provide a bright chromatic developer.

A still further object of the invention is to provide a developer which facilitates a cleaning step without staining, abrading or flawing of an electrostatic latent image-bearing surface.

Another object of the invention is to provide a developer with a good fixation characteristic, particularly a developer with no problem in respect of high-temperature offset.

A still further object of the present invention is to provide a charge-imparting material or member improved in charge-imparting capability for imparting an appropriate amount of negative charge to a toner.

A further object of the invention is to provide an improved charge-imparting material which is less liable to deteriorate in its performance during a long period of use.

A still further object of the invention is to provide a charge-imparting material or member adapted to a chromatic toner.

A generic object of the present invention is to provide a triboelectrically chargeable composition inclusive of a toner for developing electrostatic images and a charge-imparting material or member with characteristics as described above.

According to a principal aspect of the present invention, there is provided a positively chargeable toner for developing electrostatic latent images comprising a binder, a colorant and a metal complex of an amino acid compound having an amino or mono-substituted amino group.

According to another aspect of the present invention, there is provided a charge-imparting material comprising the above mentioned metal complex of an amino acid compound, and a base material carrying the metal complex. Herein, the term "charge-imparting material" is intended to cover materials having a function of imparting triboelectric charge to a toner, which are in the form of particles such as magnetic particles or carrier particles used in combination with a toner to form a two-component developer or a solid member such as a doctor blade, a toner-carrying member such as a sleeve, and other members which contact a toner before or during a developing step. The term "carrying" has been used to cover the cases where the metal complex is dispersed in the base material which may be in the form of particles or a solid member as described above, or carried as a coating on the surface or an embedded substance in the surface layer of the base material.

According to a broader and generic aspect of the present invention, there is provided a triboelectricallly chargeable composition comprising the above mentioned metal complex and a base material carrying the metal complex. Herein, the term "composition" has been used to cover the toner and the charge-imparting material as described above. Accordingly, the term "base material" used herein is intended to cover materials in the form of particles inclusive of particles constituting toners and carrier particles. The term "carrying" has the same meaning as described above.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing schematically illustrated a developing apparatus which is used to effect development by using a toner according to the present invention.

DETAILED DESCRIPTION OF THE INVENTION

The present invention is based on our discovery of the facts as follows. Thus, a metal complex of an amino acid compounds which is an organic compound having at least an amino group or monosubstituted amino group and a carboxyl group, is stable both thermally and against the elapse of time, little hygroscopic and substantially colorless or pale. Therefore, when it is contained in a toner, the hue of a colorant in the toner is not deteriorated thereby, so that the toner can present a bright chromatic color. Based on these characteristics and the fact that it can appropriately control the charge of the toner, the metal complex of an amino acid compound can be a good positive charge controller.

The metal complex of an amino acid compound may comprise only an amino acid compound as the ligand or may comprise a ligand of an amino acid compound along with another ligand which is other than an amino acid compound. Examples of such another ligand to be used in combination with a ligand of an amino acid compound include aromatic compounds including those having at least two groups of the same or different kinds selected from amino, hydroxyl and carboxyl attached to adjacent cites of a benzene ring, an alkyl($C_1$–$C_5$)-substituted benzene, naphthalene an alkyl ($C_1$–$C_5$)-substituted naphthalene. Specifically preferred examples of such another ligand include the following:

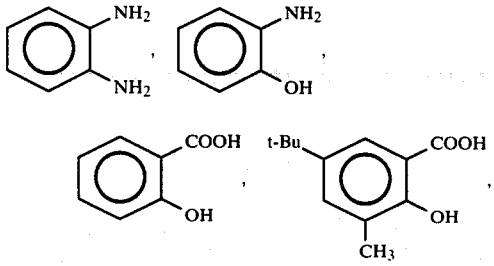

-continued

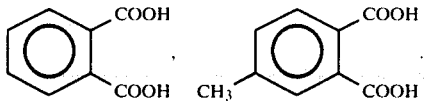

When, the metal complex comprises two or three ligands of amino acid compound. The ligands may be the same or different from each other. However, the same ligands are preferred because of easiness of production and stability of the complex.

Examples of the amino acid compound include the following classes (A) to (D).

(A) A first class of amino acid compounds are represented by the following formula (III):

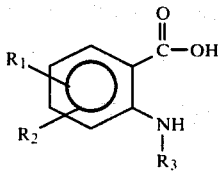

(III)

wherein $R_1$ and $R_2$ are respectively hydrogen, halogen, nitro group, amino group, substituted amino group, alkyl group ($C_1$–$C_{10}$), sulfamoyl group, substituted sulfamoyl group, or those groups in combination forming a ring which can have a substituent, and $R_3$ is hydrogen, alkyl group ($C_1$–$C_9$), benzyl group, phenyl group, or substituted phenyl group.

Examples of the substituted which may substitute for a hydrogen to form a substituted amino group in the present invention include those usable as an $R_3$ group mentioned above. Examples of the substituent which may substitute for a hydrogen to form a substituted sulfamoyl group, a substituted phenyl group or a ring having the substituent include alkyls ($C_1$–$C_4$), hydroxyl and hydrogen. The above holds true with the amino acid compounds of the classes (A) to (D) described herein.

The amino acid compounds represented by the formula (III) may be reacted in a known manner with metal compounds to provide metal complexes (chelate compounds) represented by the following formula (I):

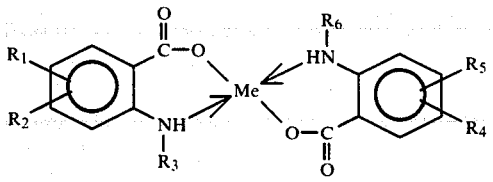

(I)

wherein $R_1$, $R_2$, $R_4$ and $R_5$ are the same or different groups selected from hydrogen, halogen, nitro group, amino group, substituted alkyl group ($C_1$–$C_{18}$), sulfamoyl group, substituted sulfamoyl group, or those groups which form a ring which can have a substituent by a combination of $R_1$ and $R_2$ or $R_4$ and $R_5$; $R_3$ and $R_6$ are the same or different groups selected from hydrogen, alkyl group ($C_1$–$C_9$), benzyl group, phenyl group, or substituted phenyl group; and Me is a metal.

The center metal atom Me may be a divalent metal such as Ni, Co, Zn, Cd, Cu, Fe, Mn, Hg and Pb; among which Zn, Co, Ni and Cu are preferred, and either one of Ni, Co and Zn is most preferred.

Halogenides of the above metals or salts of the above metals with an organic acid such as acetic acid may be, for example, used as a metal donor for producing a chelate compound.

In order to obtain a symmetrical chelate compound, a Na or K salt of a coordinating amino acid compound (i.e., an amino acid ligand) is dissolved or dispersed in water or an organic solvent such as methanol, ethanol or ethyl cellosolve, and a metal-donor compound is added thereto in such an amount that the mol ratio between the amino acid compound and the metal will be 2:1. The mixture is then warmed and a pH controller is added thereto to cause a reaction to form a chelate compound. When the chelate compound is obtained in a slurry form, it is recovered by filtering as it is. When the chelate compound is formed in a solution, the solution is diluted with an aqueous solution of a mineral acid to precipitate the compound and then recover it by filtering.

In order to obtain an asymmetric metal complex, one of the coordinating amino acid compounds is dissolved or dispersed in water or an organic solvent such as methanol or ethanol, and a metal-donor compound is added thereto in a mol ratio of 1:1. Then, the mixture is warmed and a pH controller is added thereto to cause a reaction, thereby producing a 1:1-type complex. Then, the other coordinating amino acid compound is added thereto to cause a reaction. The resultant precipitate is recovered by filtering.

The thus obtained chelate compound of an amino acid compound (hereinafter "amino acid chelate compound", "amino acid metal complex" or simply "metal complex") is subjected to post-treatment steps, as desired, such as purification, drying, crushing, etc., to be recovered.

Specific examples of the amino acid compound represented by the formula (III) include: anthranilic acid, 3-methylanthranilic acid, 3-ethylanthranilic acid, 3-n-butylanthranilic acid, 3-stearylanthranilic acid, 5-methylanthranilic acid, 5-ethylanthranilic acid, 5-isopropylanthranilic acid, 5-tert-butylanthranilic acid, 5-laurylanthranilic acid, 3,5-dimethylanthranilic acid, 3,5-diethylanthranilic acid, 3,5-dibutylanthranilic acid, 3-methyl-5-isopropylanthranilic acid, 3-methyl-5-tert-butylanthranilic acid, 4-chloroanthranilic acid, 5-chloroanthranilic acid, 5-nitroanthranilic acid, 5-acetoaminoanthranilic acid, 5-sulfamoylanthranilic acid, 3-amino-2-naphthoic acid, 1-amino-2-naphthoic acid, 7-ethyl-3-amino2-naphthoic acid, 7-heptyl-3-amino-2-naphthoic acid, 6-N-methylsulfamoyl-3-amino-2-naphthoic acid, 8-oxy-3-amino-2-naphthoic acid, 1-aminotetralin-2-carboxylic acid, 2-aminotetralin-3-carboxylic acid, 6-tert-butyl-1-aminotetralin-2-carboxylic acid, N-methylanthanilic acid, 4-chloro-N-methylanthranilic acid, N-phenylanthranilic acid, N-2,3-xylylanthranilic acid, N-benzylanthranilic acid, 3-N-methylamino-2-naphthoic acid, 3-N-benzylamino-2-naphthic acid, 1-aminoanthranquinone-2-carboxylic acid.

PRODUCTION EXAMPLE 1

(Synthesis of anthranilic acid nickel chelate)

54.8 g (0.4 mol) of anthranilic acid was completely dissolved in a solution obtained by dissolving 16 g (0.4 mol) of caustic soda in 1 liter of water. The solution was heated to 80° C., and a solution of 25.9 g (0.2 mol) of nickel chloride in 150 ml of water was gradually added dropwise to the heated solution. After the addition, the mixture was stirred for 1 hour at 80° C. and then allowed to be cooled down to room temperature under stirring. After the cooling, the resultant precipitate was filtered out and washed with water until the filtrate water reached neutrality. After washing, the precipitate was dried at 90° C. to obtain about 65 g of pale blue powder.

PRODUCTION EXAMPLE 2

(Synthesis of 5-methylanthranilic acid zinc chelate)

27.3 g (0.2 mol) of zinc chloride was dissolved in 500 ml of ethylene glycol. To the solution was gradually added 60.4 g (0.4 mol) of 5-methyl-anthranilic acid. After the addition, the mixture was stirred for 2 hours at 130° C. and then dispersed in 3 liters of water. The dispersion was subjected to filtration and the precipitate was washed with water until the filtrate water reached neutrality. The precipitate was then dried at 90° C. to obtain about 40 g of white powder.

PRODUCTION EXAMPLE 3

(Synthesis of N-methylanthranilic acid nickel chelate)

23.8 g (0.1 mol) of nickel acetate was added to 500 ml of ethyl cellosolve and stirred. The mixture was heated to 50° C., and 30.2 g (0.2 mol) of N-methyl-anthranilic acid was gradually added. The mixture was subjected to reaction for 2 hours at about 130° C. under refluxing and then dispersed in 2 liters of water. After 1 hour, the dispersion was subjected to filtration and the precipitate was washed with water until neutrality. The precipitate was then dried at 90° C. to obtain about 29 g of pale blue powder.

PRODUCTION EXAMPLE 4

(Synthesis of N-phenylanthranilic acid cobalt chelate)

24.9 g (0.1 mol) of cobalt acetate was added to 500 ml of dimethylformamide and completely dissolved. The solution was heated to 50° C., and 42.6 g (0.2 mol) of N-phenylanthranilic acid was gradually added thereto. The mixture was allowed to react for 3 hours at about 145° C. under refluxing, and the heating was terminated. The mixture, when cooled down to 100° C., was dispersed in 2 liters of water and, after 1 hour, subjected to filtration. The precipitate was washed with water until neutrality and then dried at 90° C., whereby about 40 g of pale reddish grey powder.

Specific examples of the chelate compounds represented by the general formula (I) include those expressed by the following formulas:

(Metal Complex Example)
(1)
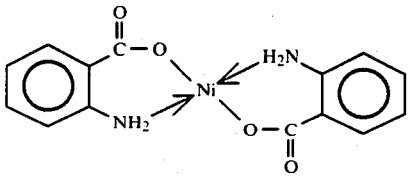
(2)
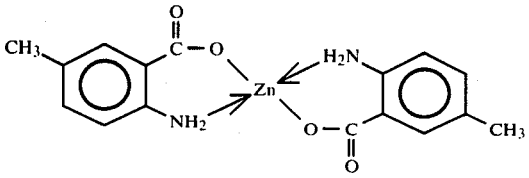
(3)
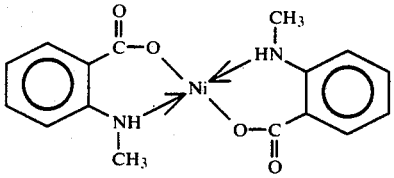
(4)
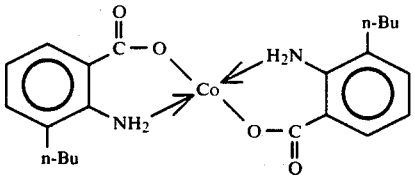
n-Bu:n-$C_4H_9$ (the same in the formulas appearing hereinafter)
(5)
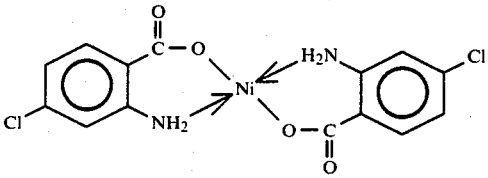
(6)
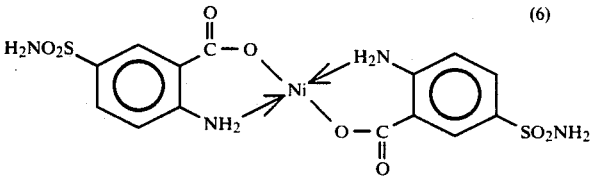
(7)
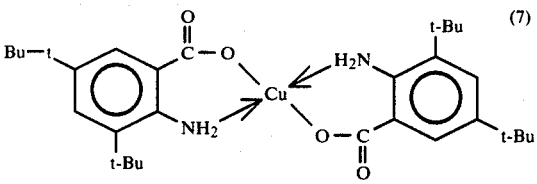
(8)
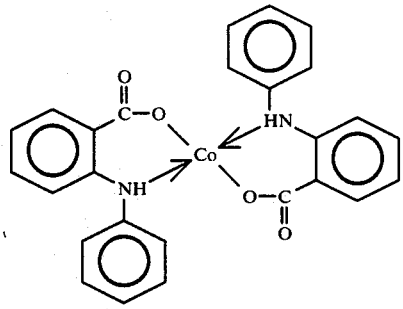
t-Bu:t-$C_4H_9$ (the same in the formulas appearing hereinafter)
(9)
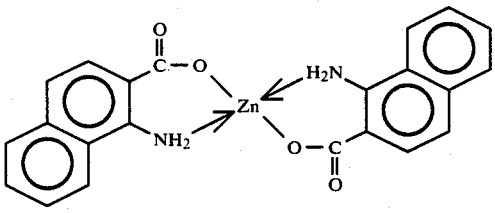
(10)
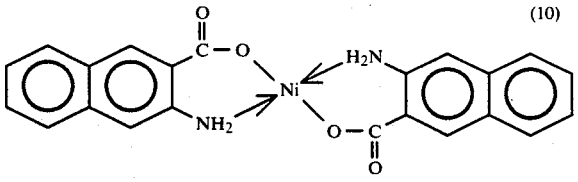
(11)
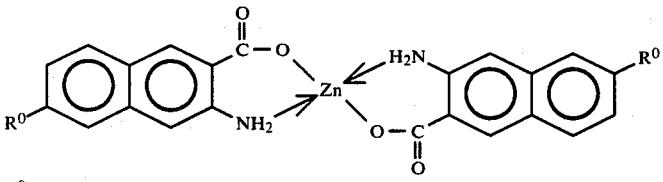
$R^0$: $-SO_2NHCH_3$
(12)
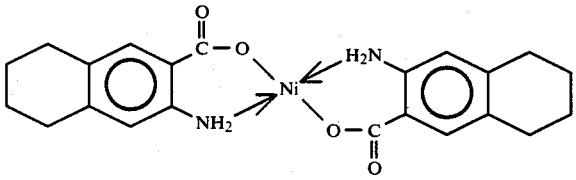

-continued
(Metal Complex Example)
(13)
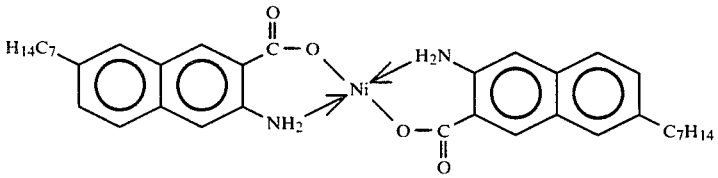
(14)
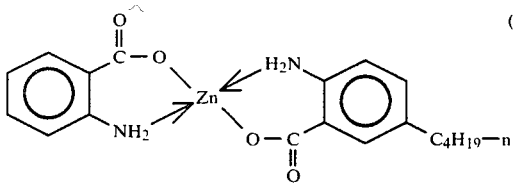
(15)
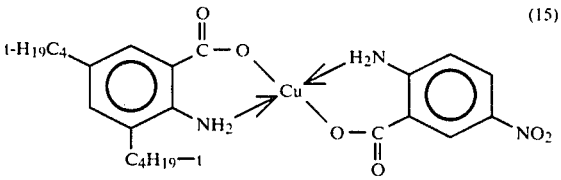
(16)
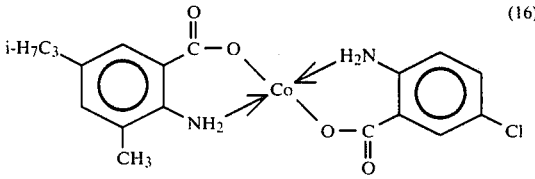
(17)
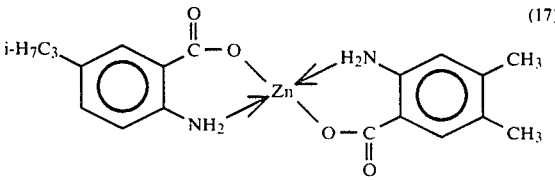
(18)
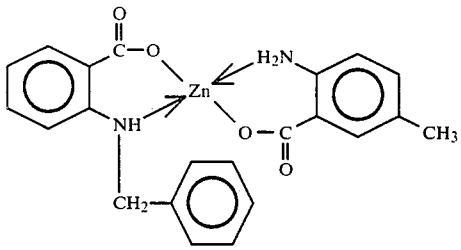
(19)
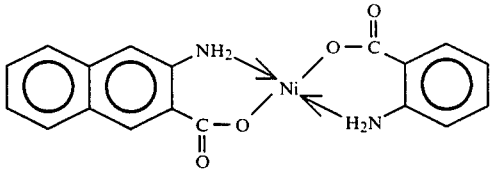
(20)
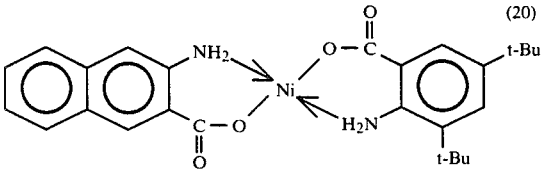
(21)
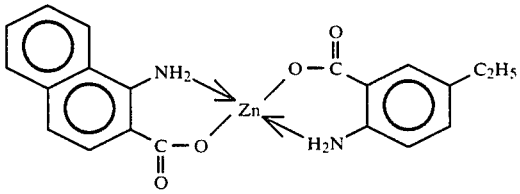
(22)
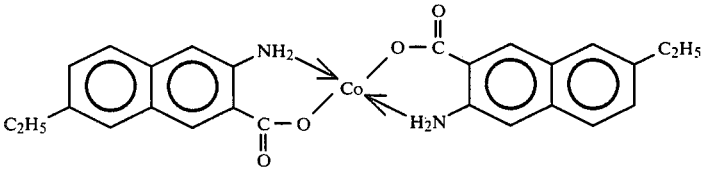
(23)
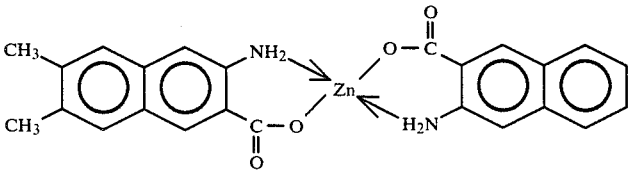
(24)
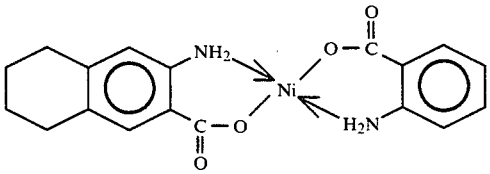
(25)
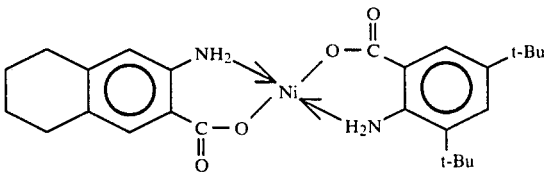

-continued (Metal Complex Example)

(26)

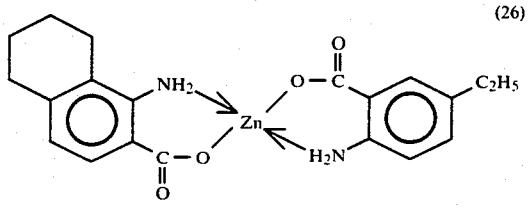

(27)

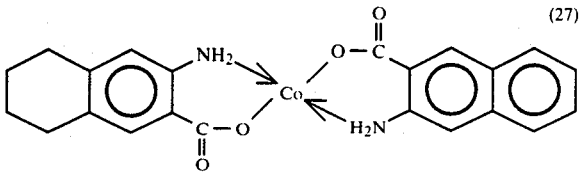

(28)

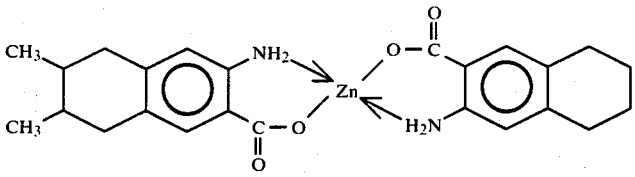

(29)

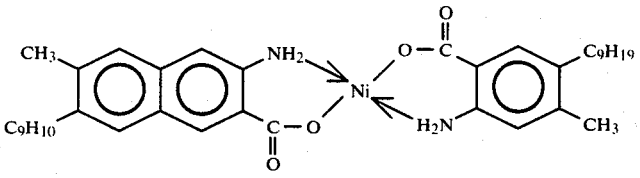

(30)

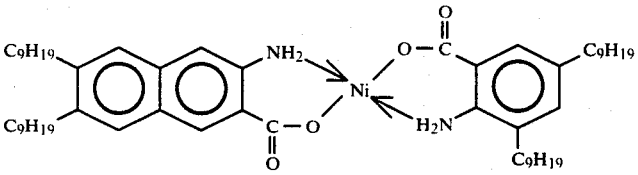

(31)

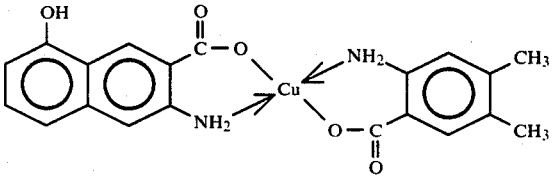

(B) A second class of amino acid compounds are represented by the following formula (II):

(II)

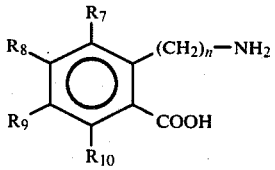

wherein $R_7$, $R_8$ and $R_9$ are respectively hydrogen on an alkyl group and may be the same or different groups, and n is an integer of 1 to 3.

Specific examples of the metal complexes include those represented by the following formulas and produced in substantially the same manner as described above from the amino acid compounds represented by the general formula (II):

(Metal Complex Example)

(32)

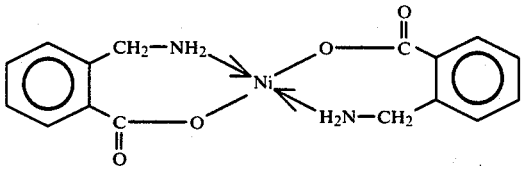

-continued
(Metal Complex Example)
(33)
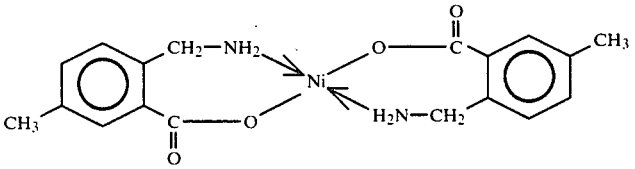
(34)
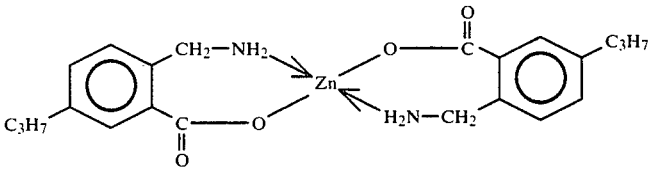
(35)
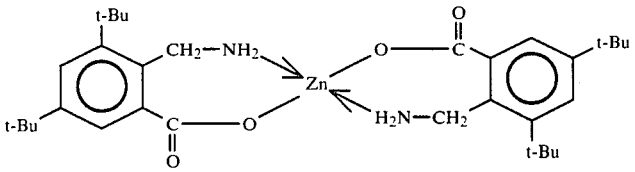
(36)
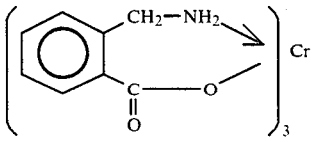
(37)
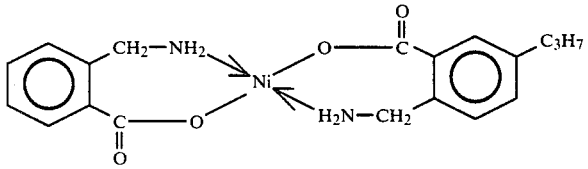
(38)
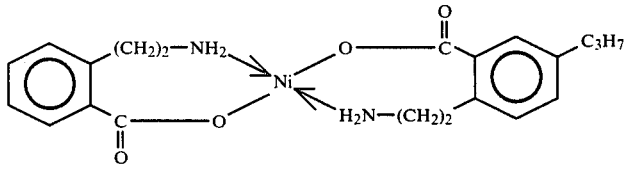
(39)
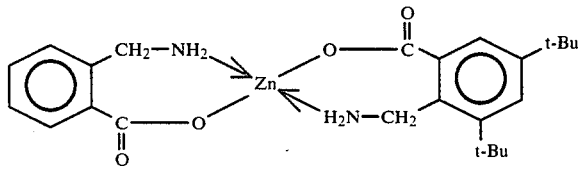
(40)
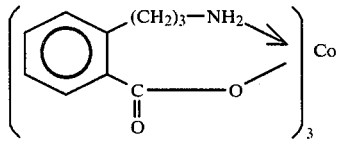
(41)
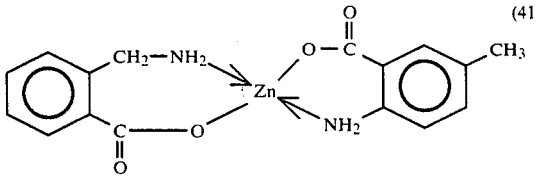

-continued
(Metal Complex Example)

(42)

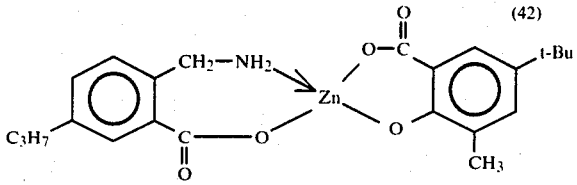

(43)

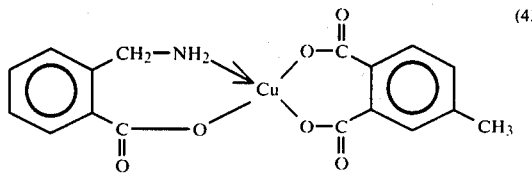

(44)

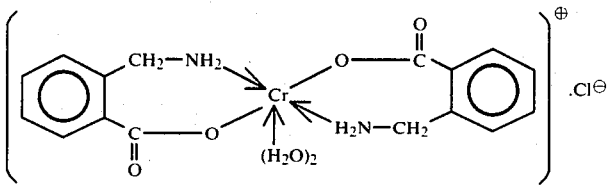

(C) A third class of amino acid compounds are hexahydroanthranilic acid and alkyl derivatives thereof.

Examples of this class of amino acid compounds include: hexahydroanthranilic acid, 3-methyl-hexahydroanthranilic acid, 4-isopropyl-hexahydroanthranilic acid, 5-lauryl-hexahydroanthranilic acid, 6-ethyl-hexahydroanthranilic acid, 3, 4-dimethyl-hexahydroanthranilic acid, 5-methyl-3-ethyl-hexahydroanthranilic acid, 3-tert-butyl-5-lauryl-hexahydroanthranilic acid, and 3, 4, 5-trimethyl-hexahydroanthranilic acid.

The metal complex to be used in the present invention may be, for example, complexes of these amino acid compounds with a metal such as Ni, Co, Zn, Cr, Fe or Al.

For example, Ni-complex of hexahydroanthranilic acid may be synthesized in the following manner:

2-Oxycyclohexane carboxylic acid is obtained by Dieckmann condensation of pimelic acid and reacted with ammonia to obtain 2-amino-1-cyclohexene carboxylic acid, which is then catalytically reduced with the use of a platinum oxide catalyst to provide hexahydroanthranilic acid.

Then, in order to obtain the metal complex, hexahydroanthranilic acid and nickelous chloride are dissolved or dispersed in methanol in a mol ratio of 2:1, and a methanol solution of sodium methylate is added thereto recover the resultant precipitate. The precipitate is dissolved in toluene, chloroform or tetrahydrofuran, and the solution is filtrated. The filtrate is evaporated off to leave the objective metal complex.

(D) A fourth class of amino acid compounds are aliphatic amino acids.

Examples of the aliphatic amino acids include: glycine, glycylglycine, glycylglycylglycine, methionine, alanine, valine, leucine, isoleucine, serine, threonine, crystine, aspartic acid, glutamic acid, lysine, arginine, $\beta$-alanine, $\gamma$-aminolactic acid, and acetylaminoacetic acid. The metal complexes may be obtained as Cu, Zn, Ni, Fe, Co, Cr or Cd chelate compounds of these aliphatic amino acids containing at least one molecule of such an aliphatic amino acid ligand.

Specific examples of the metal complexes include: tris(glycinato)chromium (III), tris(glycinato)cobalt (III), potassium bis(glycinato)oxalatocobaltate (III), sodium bis(glycinato)oxalatocobaltate (III), barium glycinatobis(oxalato)cobaltate (III), bis(glycinato) ethylenediaminecobalt (III) iodide, glycinatobis(ethylenediamine)cobalt (III) iodide, glycinato(triethylenetetramine) cobalt (III) iodide, carbonatoglycinatoethylenediaminecobalt (III) potassium tris(glycinato)nickelate (II), bis(glycinato)diaquanickel, bis(glycinato)diamminenickel (II), bis(glycinato)copper (II), bis(glycinato)platinum (II), potassium dichloroglycinatoplatinate (II), sarcocinatotetraamminecobalt (III) nitrate, tris(L-alaninato)cobalt (III), L-ananinatobis(ethylenediamine)cobalt (III) iodide, bis(alaninato)copper (II), tris($\beta$-alaninato)cobalt (III), bis($\beta$-alaninato)copper (II), sodium bis(L-aspartato) cobaltate (III), sodium bis(glycylglycinato)cobaltate (III), ammonium bis(glycylglycinato)cobaltate (III), potassium(glycylglycinato)cobaltate (III), (glycylglycinato)aquacopper (II), chloro(glycylglycinato) aquacopper (II), sodium glycylglycinatocuprate (II), glycylglycylglycinatocopper (II), and glycylglycylglycinatocopper (II) chloride.

These metal complexes of aliphatic amino acids may be synthesized in known manners. Specific examples of production will be described hereinbelow.

(a) Tris(glycinato)chromium (III)

15.8 g of $CrCl_3 \cdot 6H_2O$ is dissolved in water, and 13.4 g of glycine is added thereto. While the mixture was under boiling, an aqueous solution containing 10 g of KOH is gradually added. On completion of the addition, a dark red solution is obtained while a purple salt is precipitated simultaneously. The precipitate is filtered out while the liquid is hot, and the filtrate, after being cooled, is condensed under reduced pressure in a vacuum desicator containing concentrated sulfuric acid thereby to obtain an objective red crystal along with a small amount of a purple salt. The purple salt is lighter than the red salt so that it can be removed by several times of washing with ethanol.

(b) Tris(glycinato)cobalt (III)

30 g of potassium bicarbonate is added to 30 ml of water and cooled with ice. On the other hand, 10 g of $CoCl_2 \cdot 6H_2O$ is dissolved in 10 ml of hot water and cooled. Then, 15 ml of 30 % aqueous solution of hydrogen peroxide is added and the mixture is cooled with ice. While the ice-cooled liquid of potassium bicarbonate prepared in advance is stirred incessantly, an aqueous solution of cobalt (II) chloride is gradually added dropwise. The reaction is proceeded while the temperature is kept below 5° C. with immersion in iced water. The resultant green liquid is quickly filtrated under suction to obtain a transparent green liquid, to which 9.5 g of glycine is added little by little. The mixture is heated on a water bath for sometime. When the color of the liquid has turned from green to blue, 6M-acetic acid is added dropwise until the generation of $CO_2$ is ceased, whereby the liquid color changes to reddish purple. The reaction liquid is filtered and the filtrate is cooled to precipitate fac-$[Co(gly)_3]$. $H_2O$ having a small solubility. The liquid product is filtered with suction to produce a filtrate, which is then condensed in a desicator containing sulfuric acid to precipitate mer-$[Co(gly)_3]\cdot 2H_2O$ having a larger solubility.

(c) Glycinatobis(oxalato)cobalt (III)

36.8 g of potassium oxalate and 12.8 g of oxalic acid are dissolved in 150 ml of water and then heated to 80° C. In the liquid, 11.9 g of cobalt carbonate is dissolved little by little and then 11.25 g of glycine is dissolved. The solution is heated to 85° -95° C., and a solution obtained by adding 30 ml of 30%-aqueous solution of hydrogen peroxide and 15 ml of glacial acetic acid is added dropwise to the heated solution in 55-60 min. In this instance, if the temperature is low, a large amount of $[Co(ox)_3]^{3-}$ formed. The reaction liquid is filtered, while it is hot, and the filtrate is quickly mixed with 800 ml of ethanol. The mixture is then allowed to stand for 45 min. The liquid is condensed by decantation, and 100 ml of ethanol is again added to form a suspension, which is, after 5 min. of stirring, subjected to filtration with suction. The precipitate is washed with ethanol and acetone, and then dried. The resultant crude blue salt is dissolved in 150 ml of 1.5 M-hydrochloric acid, and 50 g of barium bromide is dissolved, whereby blue $Ba[Co(ox)_2(gly)]$ begins to precipitate. After 15 min., the precipitate is filtered out and washed with 25 ml of water. The precipitate is then suspended in 150 ml of water for 1 hour and filtered out. The filtered product is washed with 100 ml of hydrochloric acid, 100 ml of water and then with ethanol and acetone. The yield is about 26 g. The corresponding Na salt can be obtained by adding the Ba salt to a liquid obtained by dissolving anhydrous sodium sulfate in 60 ml of water and by shaking the mixture for 10 min. After the removal of barium sulfate by filtration, ethanol is added carefully to the filtrate to precipitate the Na salt.

(d) Bis(glycinato)ethylenediaminecobalt (III) salt 2 g of mer(N)-$[Co(CO_3)(gly)(en)]$ is added to a solution of 1.2 g of glycine in 20 ml of water. The mixture liquid is then condensed to 5 ml at about 70° C. on a water bath and then filtered with suction while it is hot. To the filtrate cooled to room temperature, a calculated amount of KI is added, whereby a dense red crystal begins to be precipitated. After the addition, the reaction product is cooled with ice overnight, and the precipitate is filtered out and recrystallized from a small amount of hot water.

(e) Sarcocinatotetraamminecobalt (III) salt

To a solution of 3.6 g of sarcocine dissolved in 35 ml of 1M-NaOH aqueous solution, 11.1 g of $[CoCl(NH_3)_4(H_2O)]SO_3$ and 3 ml of 2M-ammoniacal aqueous solution are added, and the mixture is, after sufficient agitation, held at 70° C. for 90 min. The solution is once subjected to filtration, and 10 g of ammonium nitrate is dissolved in the filtrate. The mixture is held at 5° C. overnight. The precipitate is filtered out and washed with 1:1 mixture of water-ethanol and then with methanol. The yield of the crude product is about 6.8 g (50 %), and it is recrystallized from a small amount of warm water containing ammonium nitrate. The recovered crystal is dried in vacuo.

(f) Tris(L-alaninato)cobalt (III)

To a mixture of 1.9 g of freshly prepared cobalt (III) hydroxide and 5.0 g of L-alanine, 80 ml of water is added, and the mixture is heated for 5 hours understirring. During this period, water is added to compensate for the amount of water reduced by evaporation While being hot, the reaction liquid is subjected to filtration, the filtered precipitate comprising unreacted cobalt (III) hydroxide and produced (+) mer and (+) fac isomers of $[Co(L\text{-}ala)_3]$is stored for further treatment. The bluish purple filtrate containing the (+) mer, (−) mer and (−) fac isomers is concentrated to about 50 ml on a water bath and then cooled to precipitate the (+) mer isomer as a purple crystal. The crystal was filtered out, washed with ethanol containing a small amount of water and dried in a vacuum desicator. The filtrate is concentrated to the proximity of dryness, to which about 20 ml of water is added to elute the soluble substance, whereby the (+) mer isomer is left and filtered out. To the filtrate under stirring is added 20 ml of 95% ethanol, whereby a small amount of the (−) fac isomer is obtained as the precipitate. The precipitate is dissolved in a small amount of water and gradually concentrated to cause recrystallization, whereby a reddish pink needle crystal is obtained. The filtrate separated from the (−) fac isomer is allowed to stand overnight at room temperature, whereby a purple crystal of the (−) mer isomer is precipitated. The crystal is recrystallized from a small amount of water by adding 95 % ethanol and after standing overnight. The yield of the(−) mer isomer is about 1.5 g.

The (+) fac isomer is recovered from the stored precipitated mixture of cobalt (III) hydroxide, (+) mer isomer and (+) fac isomer. The mixture is suspended in a small amount of water, and sulfur dioxide is flown through the suspension until the cobalt (III) hydroxide is completely dissolved. The non-decomposed product is filtered out and sufficiently washed with hot water until the washing liquid becomes colorless, whereby the (+) mer isomer is completely extracted to leave only the (+) fac isomer. The (+) mer isomer is obtained by concentrating the extract and added to the (+) mer isomer obtained above and recrystallized from a small amount of water by he addition of ethanol. Thus, the (+) mer precipitate is dissolved in a small amount of 50%-sulfuric acid or 60% perchloric acid, and is poured into a large amount of water while stirring incessantly, whereby reddish pink crystalline powder is immediately precipitated. The powder is washed with water, ethanol and ether in this order and dried in air. The yield of the (+) fac isomer is about 0.8 g.

The metal complex of an amino acid compound (hereinafter referred to as "amino acid metal complex", simply as "metal complex" or "charge controller compound") according to the present invention may suitably be prepared in an average particle size of 0.01 to 10μ, particularly 0.1 to 2μand used for preparation of the triboelectrically chargeable composition according to the invention inclusive of the toner and the charge-imparting material. Accordingly, if the amino acid metal complex is obtained in a larger particle size, it is desirable to pulverize and classify it to a prescribed particle size.

First of all, the above-mentioned amino acid metal complex may be added to a toner (colored fine particles) comprising, as essential components, a binder resin and a colorant. More specifically, the metal complex may be added to a toner internally (incorporated inside the toner particles) or externally (mixed to adhere to the surface of the toner particles). The internal addition is preferred because it can stabilize the triboelectric charging characteristic for a long period of time.

In the case of the internal addition, the amount of the amino acid metal complex to be added may depend on several factors involved in a toner production process including kind of binder resin, optionally used additive and method of dispersion and are not determinned in a single way. However, the metal complex should preferably be used in a proportion of 0.1 to 20 wt. parts, more preferably 0.5 to 10 wt. parts, per 100 wt. parts of the binder resin.

In the case of the external addition, the metal complex should preferably be used in a proportion of 0.01 to 10 wt. parts, parituclarly 0.5 to 5 wt. parts, per 100 wt. parts of the binder resin.

A conventional charge controller may be used in combination with the charge controller copound according to the invention within an extent that it does not provide a harmful effect to the toner according to the invention. The binder resin for the toner of the present invention may be composed of homopolymers of styrene and derivatives thereof such as polystyrene, poly-p-chlorostyrene and polyvinylouene; styrene copolymers such as styrene-p-chlorostyrene copolymer, styrene-propylene copolymer, styrene-vinyltoluene copoymer, styrene-vinyl-naphthalene copolymer, styrene-methyl acrylate copoymer, styrene-ethyl acrylate copoymer, styrenebutyl acrylate copolymer, styrene-octyl acrylate copolymer, styrene-methyl methacrylate copoymer, styrene-ethyl methacrylate copolymer, styrene-butyl methacrylate copoymer, styrene-methyl-$\alpha$-chloromethacrylate copolymer, styrene-acrylonitrile copoymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrileindene copoymer, styrene-maleic acid copolymer, styrene-maleic acid ester copolymer and styrene-dimethylaminoethyl methacrylate copoymer; polymethyl methacrylate, polybutyl methacrylate, polyvinyl chloride, polyvinyl acetate, poyethylene, polypropylene, polyesters, polyurethanes, polyamides, epoxy resins, polyvinyl butyral, polyacrylic acid resin, rosin, modified rosins, terpene resin, phenolic resins, aliphatic or alicyclc hydrocarbon resins, aromatic petroleum resin, chlorinated paraffin, paraffin wax, etc. These binder resins may be used either singly or as a mixture.

A styrene copolymer is preferred and particulary a styrene-an acrylate copolymer, a styrene-a methacrylate copoymer, a styrene-an acrylate-a monoakyl maleate copolymer or a styrene-a methacrylate-a monoalkyl maleate copoymer is preferred in view of the chargeability, developing characteristic and durability of the toner. The folowing binder resins may suitably be used singly or as a mixture, in particular, for providing a pressure-fixable toner:

Polyolefins such as low molecular-weight polyethylene, low molecular-weight polypropylene, polyethylene oxide and poly-4-fluoroethylene waxes such as polyethylene wax and paraffin wax; epoxy resin, polyester resin, styrene-butadiene copolymer (monomer ratio 5-30:95-70), olefin copolymers such as ethylene-acrylic acid copoymer, ethylene-acrylate copolymers, ethylene-methacrylic acid copolymer, ethylene methacrylate copoymers, ethylene-vinyl chloride copolymer, ethylene-vinyl acetate copolymers and ionomer resins); polyvinyl pyrrolidone, methyl vinyl ether-maleic anhydride copolymer, maleic acid-modified phenolic resin, and pheno-modified terpene resin.

The colorant to be used in the present invention may be one or a mixture of known dyes or pigments including Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes.

The toner according to the invention may be composed as a magnetic toner by incorporating therein a magnetic material. In this case, the magnetic material also functions as a colorant and the other colorant need not be used additionally. The magnetic material to be used for this purpose may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These magnetic materials may preferably be in the form of particles having an average particle size of the order of 0.1 to 2 microns and be used in the toner in an amount of about 20-200 wt. parts, particularly 40-150 wt. parts, per 100 wt. parts of the resin component.

The toner according to the present invention may be mixed with carrier particles in a proportion of generally 1 part by weight of the toner with 1 to 200 parts by weight of the carrier particles to form a two-component developer. The carrier particles to be used for this purpose may be those known in the art including, for example, powder or particles of metals such as iron, nickel, aluminum and copper, alloys of these metals or metal compounds including oxides of these metals; and powder or particles of ceramics such as glass, SiC, $BaTiO_2$ and $SrTiO_2$. These particles may be coated with a resin, etc. Alaternatively, resin particles or resin particles containing a magnetic material may also be used.

Another optional additive may be added externally or internally to the toner so that the toner will exhibit further better performances. Optional additives to be used as such include, for example, lubricants such as teflon and zinc stearate; abrasives such as cerium oxide and silicon carbide; flowabiity improvers such as colloidal silica and aluminum oxide; anti-caking agent; conductivity-imparting agents such as carbon black and tin oxide; or fixing aids or anti-offset agents such as low molecular-weight polyethylene.

These additives may preferably have the same triboelectric polarity as the toner or have almost no triboelectric chargeability in order to have the toner fully exhibit its effect. For example, in the case of colloidal silica a silica showing a negative chargeability when subjected to friction with a carrier or a sleeve is not desirable. More specifically, a silica having hydrophobicity and positive chargeability obtained by surface-treating coloidal silica with a nitrogen-containing silica coupling agent or a nitrogen containing siicone oil is preferred.

The toner for developing electrostatic images according to the present invention may be produced by sufficienty mixing the positive charge controller compound according to the invention comprising an amino acid metal complex with a thermoplastic resin such as those enumerated hereinbefore, a pigment dye or magnetic material as a colorant and an optional additive, etc., by means of a mixer such as a ball mix etc.; then meting and kneading the mixture by hot kneading means such as hot rollers, kneader and extruder to disperse or dissove the pigment or dye, the charge controller and optional additives, if any, in the melted resin; cooling and crushing the mixture; and subjecting the powder product to classification to form toner particles having an average particle size of 5 to 20 microns.

Alternatively, another method may be used such as a method of dispersing in a solution of the binder resin the other prescribed components and spray-drying the dispersion; or a method of mixing in a monomer providing the binder resin the other prescribed ingredients to form a suspension and polymerizing the suspension to obtain a toner.

Further, as briefy described hereinbefore, the toner according to the invention can also be produced by first producing a toner by omitting all or a part of the charge controler compound and then externally adding the charge controller compound.

The toner according to the present invention may preferably be an insulating toner having an electrical resistivity of $10^{12}$ ohm.cm or higher so as to have a positive charge and an electrostatic transfer characteristic.

The thus obtained toner according to the present invention may be used as a positively chargeable toner in known manners for developing electrostatic latent images obtained by electrophotography, electrostatic recording, electrostatic printing, etc., to visualize the latent images, whereby advantageous effects as described below are attained.

As described above, the toner according to the invention containing an amino acid metal complex as a positive charge controller have various excellent characteristics such that individual particles of the toner are caused to have a uniform triboelectric charge, and the amount of the charge is easily controlled and does not cause fluctuation or decrease. Thus, a very stable toner is obtained. Accordingly, undesirable phenomena are obviated such as development fog, toner scattering, and contamination of a photosensitive material for electrophotography and a copier. Further, the toner according to the present invention does not cause agglomeration blocking or low-temperature fluidization. Thus, the toner can withstand a long period of storage, and the toner image is also excellent in abrasion resistance, fixation characteristic and adhesion characteristic.

These advantageous effects of the toner according to the invention are more fully exhibited when it is used in a repetitive transfer-type copying system wherein charging, exposure, developing and transfer operations are continuously and repetitively carried out. Further, as the charge conroller per se is colorless or pale in color and therefore does not provide little hindrance to color hue, so that the toner can provide an excellent chromatic color image when formulated as a toner for color electrophotography.

Hereinabove, the toner according to the present invention which is a typical and most preferred embodiment of the triboelectrically chargeable composition according to the present invention, has been fully described with respect to its ingredients, production process and use thereof. However, the triboelectrically chargeable composition according to the present invention may also be embodied as a charge-imparting material (or member) or toner movement-regulation material inclusive of magnetic particles, a carrier, a doctor blade, a toner-carrying member such as a sleeve by utilizing an excellent positive chargeabiity of the amino acid metal complex according to the invention. The charge-imparting material may be defined as a solid material which imparts or supplements a charge necessary for development to a toner while contacting the toner prior to or during the developing step.

In order to provide the charge-imparting material according to the invention, the amino acid metal complex according to the invention may be applied as a coating on or dispersed or incorporated in a base material which may be in the form of carrier particles or a fixed member such as a doctor blade or sleeve.

For this purpose, the charge controller compound, i.e., the amino acid metal complex according to the invention, may be used as such in the form of particles, or dispersed in a solvent or dispersant, or otherwise dispersed in a resin or a solution thereof. Powder of a ceramic material such as silica, aluminum oxide, cerium oxide or silicon carbide may be added to the above as a filler. Further, a conductivity imparting agent such as carbon black or tin oxide may be added to control the conductivity. In order to avoid the deposition or accumulation of spent toner on the sleeve or carrier particles as embodiments of the charge-imparting material, a releasing agent such as an aliphatic acid metal salt or polyvinylidene fluoride may be added.

As the resin for carrying or dispersing the charge controller compound according to the present invention may be those generally used including polystyrene, polyacrylic acid esters, polymethacrylic acid esters, polyacrylonitrile, rubber resins such as polyisoprene and polybutadiene, polyester, polyurethane, polyamide, epoxy resin, rosin, polycarbonate, phenolic resin, chlorinated paraffin, polyethylene, polypropylene, silicone resin, teflon, etc. Derivatives of these resins, copolymers of constituted monomers of these resins and mixtures of these resins may also be used.

The coating amount or content of the charge controller compound on the surface or in the surface layer of the charge-imparting material for development of electrostatic images which may be carrier particles, magnetic particles, a sleeve or a doctor blade, should be appropriately controlled and preferably be 0.01–10 mg/cm $^2$, particularly 0.01–2 mg/cm$^2$ The carrier particles as an embodiment of the charge-imparting material, particularly the base material thereof, may be those as described above to be combined with the toner according to the invention.

The sleeve as another embodiment of the charge-imparting material may be formed of, for example, metals such as iron, aluminum, stainless steel and nickel or alloys of these metas. Further, the sleeve may be formed of a non-metalic substance such as ceramics and plastics.

In order to produce the charge-imparting material, for example, the carrier particles may be obtained by dipping the base or core particles in a dispersion of the charge controller compound in a resin soution or dispersion or applying the dispersion to the base particles, and thereafter drying the coated particles, as desired.

The sleeve may be obtained by applying the dispersion of the charge controller compound as described above by dipping, spraying, brush coating.

Alternatively, the charge controller compound according to the invention may be dispersed in a shapable resin to form carrier particles, a sleeve or a doctor blade.

The present invention will be more specifically explained with reference to examples, while it is to be understood that the present invention is not limited to the specifically described examples. In the examples, "parts" used for describing formulations are all by weight.

EXAMPLE 1

| | |
|---|---|
| Styrene/butyl acrylate copolymer (comonomer weight ratio = 80:20, molecular weight Mw = about 300,000 | 100 parts |
| Carbon black (Mitsubishi #44) | 5 parts |
| Low-molecular weight polyethylene wax | 2 parts |
| Anthranilic acid nickel chelate | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine toner power with particle sizes of 5–20 microns. Then, 5 parts of the toner wax mixed with 100 parts of iron powder carrier having an average particle size of 50–80 microns to prepare a deveoper. The triboelectric charge of the toner in the developer was measured to be +7.3 μC/g according to an ordinary the toner was found to have a positive chargeability.

Then, a negative electrostatic image was formed on an OPC (organic photoconductor) photosensitive member by a known electrophotographic technique and developed with the abov prepared developer containing a positively charged toner by the magnetic brush method to form a toner image, which was electrostatically transferred to plain paper and heat-fixed by means of hot press rolers. The thus obtained image had a sufficiently high density of 1.24 and was free of fog and toner scattering around the imge, thus found to be a good image with a high resoution. The above developer was used in a successive copying test for successively forming transferred images so as to check the durability, whereby transferred images after 30,000 sheets of copying were not at all inferior to those obtained at the initial stage.

Further, during the successive copying test, the above-mentioned phenomenon of "filming"on the photosensitive member was not observed, nor was observed any problem during the cleaning step. No trouble was encountered in the fixing step either. After the termination of th 30,000 sheets of the successive coying test, the fixing device was observed, whereas no flaw or damage was observed on the rollers nor was observed almost any staining with offset toner, thus being practically of no problem.

Further, when the environmental conditions were changed to 35° C.–85%, clear images were obtained without fog or scattering, and an image density of 1.20 which was substantially equal to that obtained under the normal temperature-normal humidity was obtained. The image quality after 30,000 sheets of successive copying did not substantially charge.

Then, when transferred images were obtained under low temperature-low humidity conditions of 15° C.–10%, excellent images could be obtained with a high image density of 1.29 and solid black portions could be very smoothly developed and transferred without scatteg or drop-off in the central parts. Under these environmental conditions, a successive copying test was conducted continuously and intermittently, whereas the fluctuation in density was ±0.2 up to 30,000 sheets of copying and practically of no probem.

COMPARATIVE EXAMPLE 1

A developer was prepared in the same manner as in Example 1 except that 2 parts of a nigrosine dye (Nigrosine EX, produced by Orient Chemical Co., Ltd.) was used in place of the 2 parts of the anthranilic acid nickel chelate, and the developer was subjected to developing, transferring and fixing. At normal temperature and normal humidity, fog occurred little, but the image density was as low as 1.06 with scattering of line images and conspicuous coarsening at the solid black portions. When successive copying test was conducted, the density was lowered to 0.83 on copying of 30,000 sheets. Further, during the successive copying test, the toner material formed a film in the form of thin streaks on the photosensitive member. This is a so-called "filming" phenomenon which is considered to have occurred because the charge controller changed the lubrication characteristic of the toner. Further, during the successive copying, the fixed image surface of recording paper was liable to be caught into fixing rolers and had a difficulty in pealability from the rollers.

When images were obtained under the conditions of 35° C. and 85%, the image density was lowered to 0.88 with increase of fog, scattering of the toner and coarsening of the image. The transfer efficiency was also as low as 69%.

When the images were obtained under the conditions of 10° C. and 10% RH, the image density was as low as 0.91, with excessive scattering, fog an coarsening, and transfer drop-off was markedly observed. Continuous image formation was effected until about 30,000 copies were produced, when the density became 0.53 to be practically unacceptabe.

EXAMPLE 2

A developer was prepared in the same manner as in Example 1 except that 3 parts of 5-methyl-anthranilic acid zinc chelate was used in place of the 2 parts of the anthranilic acid nickel chelate, and the obtained developer was similarly subjected to developing, transferring and fixing to obtain images.

Satisfactory results substantially the same as in Example 1 were obtained. Detailed results are shown in Tables 1 and 2.

EXAMPLE 3

A developer was prepared in the same manner as in Example 1 except that 2 parts of 3,5-di-tertbutylanthranilic acid nickel chelate was used in place of the 2 parts of anthranilic acid nickel chelate, and the obtained developer was similarly subjected to developing, transferring and fixing to obtain images.

The results are also shown in Tables 1 and 2.

EXAMPLE 4

A developer was prepared in the same manner as in Example 1 except that 2 parts of 3-lauryl-5-methylanthranilic acid cobalt chelate was used in place of the 2 parts of the anthranilic acid nickel chelate, and the obtained developer was similarly subjected to developing, transferring and fixing to obtain images.

The results are also shown in Tables 1 and 2.

EXAMPLE 5

| | |
|---|---|
| Styrene/butyl acrylate (80:20) copolymer (weight average molecular weight Mw: about 300,000) | 100 parts |
| Magnetite EPT-5000 (produced by Toda Kogyo K.K.) | 60 parts |
| Low-molecular weight polypropylene wax | 2 parts |
| Anthranilic acid nickel chelate | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with a sizes of 5–20 microns. Then, 0.4 part of positive colloidal silica treated with aminomodified silicone oil (produced by Nihon Aerosil K.K.) was admixed with 100 parts of the fine powder as obtained above to prepare a one-component magnetic toner.

The triboelectric charge of the toner was measured according to an ordinary blow-off method.

The toner was applied to a commercially available copier (Trade name: NP-150Z mfd. by Canon K.K.) for imaging, whereby substantially the same results as in Example 1 were obtained.

The resultant image showen in Tables 1 and 2.

EXAMPLE 6

A developer was prepared in the same manner as in Example 5 except that 3 parts of N-methylanthranilric acid nickel chelate was used in place of 2 parts of the anthranilic acid nickel chelate, and the obtained developer was simiarly subjected to developing, transferring and fixing to obtain images.

The results are also shown in Tables 1 and 2.

EXAMPLE 7

A developer was prepared in the same manner as in Example 5 except that 2 parts of 3-n-butylanthranilic acid cobalt chelate was used in place of 2 parts of the anthranilic acid nickel chelate, and the obtained developer was similarly subjected to developing, transferring and fixing to obtain images.

The results are also shown in Tables 1 and 2.

COMPARATIVE EXAMPLE 2

A deveoper was prepared in the same manner as in Example 5 except that 2 parts of benzyldimethyl-hexadecylammonium chloride was used in place of 2 parts of the anthranilic acid nickel chelate and the developer was subjected to developing, transferring and fixing. At normal temperature and normal humidity, fog occurred little, but the image density was as low as 0.8 with scattering of line images and conspicuous coarsening at the solid black portions. When successive copying test was conducted, the density was lowered to 0.48 on copying of 30,000 sheets. Further, during the successive copying test, the undesirable "filming" phenomenon and the difficulty in the fixing step were encountered almost equally as in Comparative Example 1.

When images were obtained under the conditions of 35° C. and 85 %, the image density was lowered to 0.72 with increase of fog, scattering of the toner and coarsening of the image, proving to be practically unacceptable. The transfer efficiency was also lowered to 63 %.

When the images were obtained under the conditions of 15° C. and 10% RH, the image density was as low as 0.73, with excessive scattering, fog and coarsening, and transfer drop-off was markedly observed. When continuous imaging was conducted, the density was lowered to 0.59 on copying of 30,000 sheets and was practically unacceptable.

EXAMPLE 8

| | |
|---|---|
| Styrene/butyl acrylate (80:20) copolymer (weight average molecular weight Mw: about 300,000) | 100 parts |
| Copper phthalocyanine blue pigment | 5 parts |
| Low-molecular weight polypropylene wax | 2 parts |
| Anthralinic acid nickel chelate | 2 parts |

The above ingredients were sufficienty blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 microns. The triboelectric charge of the toner was measured to be 11.2 $\mu$C/g by the blow-off method.

Then, 100 parts of the fine powder was mixed with 50 parts of magnetic particles having particle sizes of 50–80 microns to prepare a developer.

The developer was used in a developing apparatus as shown in the accompanying drawing to effect imaging. More specifically, in the apparatus, a container 1 was provided with a cylindrical tonercarrying member 2 so that the toner-carrying member (sleeve) 2 amost blocked up the lower opening of the container 1. The toner-carrying member was made of a stainless steel cylinder with a roughened surface and rotated at a peripheral speed of 66 mm/sec. in the direction of arrow a. On the other hand, at exit provide at the downstream end of the container 1 in the rotational direction of the sleeve 2, an iron blade 3 was disposed with its tip 200 microns away from the sleeve surface. Inside the sleeve 2 was disposed a fixed magnet 4 with its N pole as a major magnetic pole thereof placed at a position forming an angle $\theta$ of 30° C between lines connecting the N pole and the tip of the blade 3, respectively, with the center of the sleeve 2. Under these conditions, as the sleeve 2 rotates, a magnetic brush 5 is formed with carrier iron powder contained in a developer in the container 1, and this magnetic brush 5 circulated along the surface of the sleeve at the lower part of the container 1 while taking therein a toner 6 distributed preferentially above the magnetic brush 5 and supplying the toner to the surface of the sleeve 2, thereby to form a thin layer 16 of the toner on the surface of the sleeve 2 at a position having passed by the blade 3.

In this Example, the thus formed thin layer of the toner of about 80 microns in thickness was used to develop a negative electrostatic image with −600 V at a bright portion and −1500 at a dark portion formed on a photosensitive drum 7 which was disposed opposite to and with a spacing of about 300 microns at the deveoping zone (the closest portion) from the sleeve 2 and rotated in the directions of arrow b at a peripheral speed of 60 mm/sec. At this time, an alternating bias voltage with a peak-to-peak value of 1.8 kV and a center value of −300 V and a frequency of 800 Hz was applied between the sleeve 2 and the photosensitive drum 7.

As a result of imaging in the manner, as described above, a good image showing a clear blue color was obtained. Substantially no change in image density was observed until the tone/carrier ratio reached 10 parts/50 parts after 1500 sheets of imaging. Thereafter, the imaging was continued for 30,000 sheets whie supplying the toner, whereby good images were continually obtained.

The results of evaluation in the above Examples and Comparative Examples under the sets of conditions of the normal temperature-normal humidity (25° C. - 60% RH), the high temperature-high humidity (35° C. - 85% RH) and the low temperature-low humidity (15° C. - 10% RH) are inclusively shown in the following Tables 1 and 2.

TABLE 1

| | Normal Temperature, Normal Humidity | | | | | | | |
|---|---|---|---|---|---|---|---|---|
| | Triboelectric charge at initial stage (μC/g) | Image density | Fog | Scattering | Reproducibility of thin lines | Image density at 30000 sheets | On successive copying Filming | Fixation |
| Example | | | | | | | | |
| 1 | +7.3 | 1.24 | o | o | o | 1.28 | o | o |
| 2 | +7.9 | 1.27 | o | o | o | 1.26 | o | o |
| 3 | +6.8 | 1.31 | o | o | o | 1.24 | o | o |
| 4 | +9.9 | 1.30 | o | o | o | 1.19 | o | o |
| 5 | +10.2 | 1.26 | o | o | o | 1.23 | o | o |
| 6 | +8.1 | 1.29 | o | o | o | 1.33 | o | o |
| 7 | +7.3 | 1.28 | o | o | o | 1.30 | o | o |
| 8 | +11.2 | 1.30 | o | o | o | 1.20 | o | o |
| Comparative Example | | | | | | | | |
| 1 | +6.3 | 1.06 | o | Δ | Δ | 0.83 | Δ | Δ |
| 2 | +2.3 | 0.81 | x | x | Δ | 0.48 | Δ | Δ |

In the above table and the tables appearing hereinafter, the symbols denote the following:
o: Good
oΔ: Rather good
Δ: Rather bad
x: Bad

TABLE 2

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 1 | 1.20 | o | 83 | 1.22 | 1.29 | o | 84 | 1.26 |
| 2 | 1.24 | o | 82 | 1.28 | 1.33 | o | 88 | 1.28 |
| 3 | 1.26 | o | 90 | 1.28 | 1.26 | o | 90 | 1.30 |
| 4 | 1.29 | o | 88 | 1.24 | 1.31 | o | 91 | 1.27 |
| 5 | 1.22 | o | 79 | 1.21 | 1.31 | o | 91 | 1.27 |
| 6 | 1.28 | oΔ | 76 | 1.26 | 1.29 | o | 80 | 1.19 |
| 7 | 1.30 | o | 88 | 1.30 | 1.32 | o | 83 | 1.26 |
| 8 | 1.19 | o | 87 | 1.26 | 1.28 | o | 81 | 1.20 |
| Comparative Example | | | | | | | | |
| 1 | 0.88 | Δ | 69 | 0.73 | 0.91 | Δ | 71 | 0.53 |
| 2 | 0.72 | x | 63 | 0.58 | 0.73 | Δ | 58 | 0.59 |

EXAMPLES 9-16

Examples 1-8 were repeated by replacing the amino acid metal complexes (chelates) used therein respectively in order with: anthranilic acid zinc chelate (in Example 9); 3,5-di-tert-butylanthranilic acid zinc chelate (Example 10); 3-methylanthranilic acid zinc chelate (Example 11); 3,4-dimethylanthranilic acid nickel chelate (Example 12); anthranilic acid zinc chelate (Example 13); 3,5-di-tert-butylanthranilic acid zinc chelate (Example 14); 3-methylanthranilic acid zinc chelate (Example 15); and anthranilic acid zinc chelate.

The results are shown in the Tables 3 and 4 appearing hereinafter.

EXAMPLES 17-24

Examples 1-8 were repeated by replacing the amino acid metal complexes (chelates) used therein respectively in order with the formerly described:

Metal Complex Example (19) (in Example 17)
Metal Complex Example (20) (in Example 18)
Metal Complex Example (21) (in Example 19)
Metal Complex Example (22) (in Example 20)
Metal Complex Example (19) (in Example 21)
Metal Complex Example (29) (in Example 22)
Metal Complex Example (21) (in Example 23)
Metal Complex Example (19) (in Example 24)

The results are inclusively shown in Tables 5 and 6 appearing hereinafter.

TABLE 3

| | Normal Temperature, Normal Humidity | | | | | | | |
|---|---|---|---|---|---|---|---|---|
| | Triboelectric charge at initial stage (μC/g) | Image density | Fog | Scat-tering | Reproduci-bility of thin lines | Image density at 30000 sheets | On successive copying | |
| | | | | | | | Filming | Fixation |
| Example | | | | | | | | |
| 9 | +11.0 | 1.35 | o | o | o | 1.29 | o | o |
| 10 | +5.2 | 1.22 | o | o | o | 1.20 | o | o |
| 11 | +7.4 | 1.36 | o | o | o | 1.30 | o | o |
| 12 | +10.5 | 1.25 | o | o | o | 1.21 | o | o |
| 13 | +8.7 | 1.31 | o | o | o | 1.25 | o | o |
| 14 | +7.2 | 1.19 | o | o | o | 1.22 | o | o |
| 15 | +7.6 | 1.31 | o | o | o | 1.25 | o | o |
| 16 | +9.1 | 1.26 | o | o | o | 1.23 | o | o |

TABLE 4

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 9 | 1.29 | o | 89 | 1.22 | 1.39 | o | 92 | 1.30 |
| 10 | 1.17 | o | 87 | 1.20 | 1.22 | o | 90 | 1.21 |
| 11 | 1.21 | o | 87 | 1.19 | 1.27 | o | 87 | 1.22 |
| 12 | 1.23 | o | 87 | 1.21 | 1.21 | o | 86 | 1.27 |
| 13 | 1.27 | o | 89 | 1.30 | 1.30 | o | 88 | 1.31 |
| 14 | 1.18 | oΔ | 90 | 1.22 | 1.22 | o | 91 | 1.23 |
| 15 | 1.25 | o | 93 | 1.21 | 1.29 | o | 90 | 1.20 |
| 16 | 1.18 | o | 90 | 1.22 | 1.24 | o | 90 | 1.22 |

TABLE 5

| | Normal Temperature, Normal Humidity | | | | | | | |
|---|---|---|---|---|---|---|---|---|
| | Triboelectric charge at initial stage (μC/g) | Image density | Fog | Scat-tering | Reproduci-bility of thin lines | Image density at 30000 sheets | On successive copying | |
| | | | | | | | Filming | Fixation |
| Example | | | | | | | | |
| 17 | +8.9 | 1.28 | o | o | o | 1.33 | o | o |
| 18 | +9.3 | 1.30 | o | o | o | 1.30 | o | o |
| 19 | +8.6 | 1.33 | o | o | o | 1.28 | o | o |
| 20 | +10.2 | 1.19 | o | o | o | 1.28 | o | o |
| 21 | +11.3 | 1.22 | o | o | o | 1.28 | o | o |
| 22 | +8.9 | 1.26 | o | o | o | 1.26 | o | o |
| 23 | +9.4 | 1.30 | o | o | o | 1.29 | o | o |
| 24 | +12.1 | 1.24 | o | o | o | 1.31 | o | o |

TABLE 6

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 17 | 1.30 | o | 82 | 1.30 | 1.33 | o | 88 | 1.34 |
| 18 | 1.28 | o | 88 | 1.31 | 1.34 | o | 88 | 1.30 |
| 19 | 1.24 | o | 79 | 1.33 | 1.31 | o | 79 | 1.30 |
| 20 | 1.25 | o | 83 | 1.27 | 1.30 | o | 80 | 1.33 |
| 21 | 1.29 | o | 91 | 1.29 | 1.27 | o | 83 | 1.26 |
| 22 | 1.20 | oΔ | 90 | 1.28 | 1.29 | o | 94 | 1.24 |
| 23 | 1.30 | o | 86 | 1.28 | 1.30 | o | 93 | 1.30 |
| 24 | 1.31 | o | 84 | 1.30 | 1.30 | o | 82 | 1.31 |

EXAMPLE 25

A toner was prepared in the same manner as in Example 1 except that 2 parts of Metal Complex Example (32) mentioned hereinbefore was used in place of 2 parts of anthranilic acid nickel chelate.

The performances of the thus obtained toner were evaluated in the same manner as in Example 1 and the results are shown in Tables 7 and 8 appearing hereinafter.

EXAMPLE 26

A toner was prepared in the same manner as in Example 25 except that 3 parts of Metal Complex Example (33) was used in place of Metal Complex Example (32).

The results of the evaluation of the toner thus obtained are also shown in Tables 7 and 8.

EXAMPLE 27

A toner was prepared in the same manner as in Example 25 except that 2 parts of Metal Complex Example (34) was used in place of Metal Complex Example (32).

The results of the evaluation of the toner thus obtained are also shown in Tables 7 and 8.

EXAMPLE 28

A toner was prepared in the same manner as in Example 25 except that 2 parts of Metal Complex Example (35) was used in place of Metal Complex Example (32).

The results of the evaluation of the toner thus obtained are also shown in Tables 7 and 8.

EXAMPLE 29

A toner was prepared in the same manner as in Example 5 except that 2 parts of Metal Complex Example (32) was used in place of 2 parts of anthranilic acid nickel chelate.

The performances of the thus obtained toner were evaluated in the same manner as in Example 5 and the results are shown in Tables 7 and 8 appearing hereinafter.

EXAMPLE 30

A toner was prepared in the same manner as in Example 29 except that 3 parts of Metal Complex Example (33) was used in place of Metal Complex Example (32).

The results of the evaluation of the toner thus obtained are also shown in Tables 7 and 8.

EXAMPLE 31

A toner was prepared in the same manner as in Example 29 except that 2 parts of Metal Complex Example (34) was used in place of Metal Complex Example (32).

The results of the evaluation of the toner thus obtained are also shown in Tables 7 and 8.

EXAMPLE 32

A toner was prepared in the same manner as in Example 8 except that 2 parts of Metal Complex Example (33) was used in place of anthranilic acid nickel chelate.

The results of the evauation of the toner thus obtained are also shown in Tables 7 and 8.

TABLE 7

| | Normal Temperature, Normal Humidity | | | | | | | |
|---|---|---|---|---|---|---|---|---|
| | Triboelectric charge at initial stage (μC/g) | Image density | Fog | Scattering | Reproducibility of thin lines | Image density at 30000 sheets | On successive copying | |
| | | | | | | | Filming | Fixation |
| Example | | | | | | | | |
| 25 | +8.4 | 1.29 | o | o | o | 1.31 | o | o |
| 26 | +7.6 | 1.27 | o | o | o | 1.31 | o | o |
| 27 | +9.3 | 1.31 | o | o | o | 1.27 | o | o |
| 28 | +10.1 | 1.33 | o | o | o | 1.28 | o | o |
| 29 | +12.2 | 1.35 | o | o | o | 1.25 | o | o |
| 30 | +11.1 | 1.27 | o | o | o | 1.30 | o | o |
| 31 | +8.8 | 1.26 | o | o | o | 1.30 | o | o |
| 32 | +8.7 | 1.28 | o | o | o | 1.33 | o | o |

TABLE 8

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 25 | 1.26 | o | 83 | 1.30 | 1.31 | o | 84 | 1.33 |
| 26 | 1.24 | o | 87 | 1.29 | 1.31 | o | 88 | 1.31 |
| 27 | 1.30 | o | 91 | 1.26 | 1.33 | o | 88 | 1.30 |
| 28 | 1.31 | o | 93 | 1.27 | 1.33 | o | 83 | 1.30 |
| 29 | 1.25 | o | 91 | 1.26 | 1.29 | o | 79 | 1.27 |
| 30 | 1.25 | oΔ | 91 | 1.31 | 1.27 | o | 89 | 1.29 |
| 31 | 1.27 | o | 88 | 1.33 | 1.27 | o | 89 | 1.26 |
| 32 | 1.29 | o | 84 | 1.28 | 1.27 | o | 93 | 1.29 |

EXAMPLE 33

A toner was prepared in the same manner as in Example 1 except that 2 parts of 4-isopropyl-hexahydroanthranilic acid nickel complex was used in place of 2 parts of anthranilic acid nickel chelate.

The performances of the thus obtained toner were evaluated in the same manner as in Example 1 and the results are shown in Tables 9 and 10 appearing hereinafter.

EXAMPLE 34

A toner was prepared in the same manner as in Example 33 except that 3 parts of hexahydroanthranilic acid zinc complex was used in place of 4-isopropyl-hexahydroanthranilic acid nickel complex.

The results of the evaluation of the toner thus obtained are also shown in Tables 9 and 10.

EXAMPLE 35

A toner was prepared in the same manner as in Example 33 except that 2 parts of 3-methyl-hexahydroanthranilic acid cobalt complex was used in place of 4-isopropyl-hexahydroanthranilic acid nickel complex.

The results of the evaluation of the toner thus obtained are also shown in Tables 9 and 10.

EXAMPLE 36

A toner was prepared in the same manner as in Example 25 except that 2 parts of 3-ethylhexahydroanthranilic acid chromium complex was used in place of 4-isopropyl-hexahydroanthranilic acid nickel complex.

The results of the evaluation of the toner thus obtained are also shown in Tables 9 and 10.

EXAMPLE 37

A toner was prepared in the same manner as in Example 25 except that 2 parts of 4-isopropylhexahydroanthranilic acid nickel complex was used in place of anthranilic acid nickel chelate.

The results of the evaluation of the toner thus obtained are also shown in Tables 9 and 10.

EXAMPLE 38

A toner was prepared in the same manner as in Example 37 except that 3 parts of hexahydroanthranilic acid cobalt complex was used in place of 4-isopropyl-hexahydroanthranilic acid nickel complex.

The results of the evaluation of the toner thus obtained are also shown in Tabes 9 and 10.

EXAMPLE 39

A toner was prepared in the same manner as in Example 37 except that 3 parts of 3-methylhexahydroanthranilic acid nickel complex was used in place of 4-isopropyl-hexahydroanthranilic acid nickel complex.

The results of the evaluation of the toner thus obtained are also shown in Tables 9 and 10.

EXAMPLE 40

A toner was prepared in the same manner as in Example 8 except that 2 parts of 4-isopropyl-hexahydroanthranilic acid nickel complex was used in place of 2 parts of anthranilic acid nickel chelate.

The performances of the thus obtained toner were evaluated in the same manner as in Example 8 and the results are shown in Tables 9 and 10 appearing hereinafter.

TABLE 9

| | Normal Temperature, Normal Humidity | | | | | | | |
|---|---|---|---|---|---|---|---|---|
| | Triboelectric charge at initial stage (μC/g) | Image density | Fog | Scattering | Reproducibility of thin lines | Image density at 30000 sheets | On successive copying | |
| | | | | | | | Filming | Fixation |
| Example | | | | | | | | |
| 33 | +10.8 | 1.31 | o | o | o | 1.24 | o | o |
| 34 | +5.9 | 1.10 | o | o | o | 1.02 | o | o |
| 35 | +7.8 | 1.25 | o | o | o | 1.21 | o | o |
| 36 | +9.2 | 1.28 | o | o | o | 1.11 | o | o |
| 37 | +8.6 | 1.24 | o | o | o | 1.13 | o | o |
| 38 | +8.0 | 1.22 | o | o | o | 1.19 | o | o |
| 39 | +8.1 | 1.18 | o | o | o | 1.21 | o | o |
| 40 | +10.0 | 1.30 | o | o | o | 1.24 | o | o |

TABLE 10

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 33 | 1.25 | o | 80–90 | 1.27 | 1.36 | o | 80–90 | 1.34 |
| 34 | 1.03 | o | " | 1.09 | 1.21 | o | " | 1.19 |
| 35 | 1.14 | o | " | 1.17 | 1.28 | o | " | 1.28 |
| 36 | 1.20 | o | " | 1.28 | 1.31 | o | " | 1.25 |
| 37 | 1.12 | o | " | 1.21 | 1.29 | o | " | 1.28 |
| 38 | 1.13 | oΔ | " | 1.21 | 1.30 | o | " | 1.24 |
| 39 | 1.09 | o | " | 1.15 | 1.25 | o | " | 1.27 |
| 40 | 1.21 | o | " | 1.24 | 1.36 | o | " | 1.32 |

EXAMPLE 41

A toner was prepared in the same manner as in Example 1 except that 2 parts of tris(glycinati)chromium (III) was used in place of 2 parts of anthranilic acid nickel chelate.

The performances of the thus obtained toner were evaluated in the same manner as in Example 1 and the results are shown in Tables 11 and 12 appearing hereinafter.

EXAMPLE 42

A toner was prepared in the same manner as in Example 41 except that 3 parts of tris(glycinato)cobalt (III) was used in place of 2 parts of tris(glycinato)chromium (III).

The results of the evauation of the toner thus obtained are also shown in Tables 11 and 12.

EXAMPLE 43

A toner was prepared in the same manner as in Example 41 except that 2 parts of tris(L-alaninato)cobalt (III) was used in place of 2 parts of tris(glycinato)chromium (III).

The results of the evaluation of the toner thus obtained are also shown in Tables 11 and 12.

EXAMPLE 44

A toner was prepared in the same manner as in Example 41 except that 2 parts of bis(L-aspartato)cobalt (III) was used in place of tris(glycinato)chromium (III).

The results of the evaluation of the toner thus obtained are also shown in Tables 11 and 12.

EXAMPLE 45

A toner was prepared in the same manner as in Example 1 except that 2 parts of tris(blycinato)chromium (III) was used in place of 2 parts of anthranilic acid nickel chelate.

The performances of the thus obtained toner were evaluated in the same manner as in Example 5 and the results are shown in Tables 11 and 12 appearing hereinafter.

EXAMPLE 46

A toner was prepared in the same manner as in Example 45 except that 3 parts of tris(glycinato)cobalt (III) was used in place of tris(glycinato)nickel (III).

The results of the evaluation of the toner thus obtained are also shown in Tables 11 and 12.

EXAMPLE 47

A toner was prepared in the same manner as in Example 25 except that 2 parts of tris(L-alaninato)cobalt (III) was used in place of tris(glycinato)chromium (III).

The results of the evaluation of the toner thus obtained are also shown in Tables 11 and 12.

EXAMPLE 48

A toner was prepared in the same manner as in Example 8 except that 2 parts of tris(glycinato)chromium (III) was used in place of 2 parts of anthranilic acid nickel chelate.

The performances of the thus obtained toner were evaluated in the same manner as in Example 8 and the results are shown in Tables 11 and 12 appearing hereinbelow.

TABLE 11

| | Normal Temperature, Normal Humidity | | | | | | | |
|---|---|---|---|---|---|---|---|---|
| | Triboelectric charge at initial stage (μC/g) | Image density | Fog | Scattering | Reproducibility of thin lines | Image density at 30000 sheets | On successive copying | |
| | | | | | | | Filming | Fixation |
| Example | | | | | | | | |
| 41 | +8.3 | 1.30 | o | o | o | 1.28 | o | o |
| 42 | +7.9 | 1.27 | o | o | o | 1.29 | o | o |
| 43 | +9.2 | 1.24 | o | o | o | 1.33 | o | o |
| 44 | +7.4 | 1.31 | o | o | o | 1.27 | o | o |
| 45 | +10.3 | 1.29 | o | o | o | 1.24 | o | o |
| 46 | +12.2 | 1.33 | o | o | o | 1.24 | o | o |
| 47 | +15.1 | 1.24 | o | o | o | 1.28 | o | o |
| 48 | +13.3 | 1.26 | o | o | o | 1.27 | o | o |

TABLE 12

| | 35° C., 85% | | | | 15° C., 10% | | | |
|---|---|---|---|---|---|---|---|---|
| | Image density | Fog | Transfer efficiency (%) | Image density at 30,000 sheets | Image density | Fog | Transfer efficiency (%) | Image density at 30,000 sheets |
| Example | | | | | | | | |
| 41 | 1.29 | o | 83 | 1.29 | 1.31 | o | 86 | 1.30 |
| 42 | 1.27 | o | 84 | 1.30 | 1.33 | o | 88 | 1.28 |
| 43 | 1.26 | o | 94 | 1.28 | 1.32 | o | 88 | 1.28 |
| 44 | 1.22 | o | 91 | 1.28 | 1.30 | o | 84 | 1.24 |
| 45 | 1.23 | o | 88 | 1.27 | 1.33 | o | 90 | 1.29 |
| 46 | 1.30 | oΔ | 79 | 1.27 | 1.26 | o | 92 | 1.27 |
| 47 | 1.24 | o | 79 | 1.28 | 1.29 | o | 92 | 1.30 |
| 48 | 1.24 | o | 83 | 1.22 | 1.30 | o | 89 | 1.31 |

EXAMPLE 49

The formerly mentioned Metal Complex Example (1) in an amount of 100 g was dissolved or dispersed in 1 liter of methyl ethyl ketone, in which was further added 1 kg of iron powder carrier (particle size: 250–400 mesh). The mixture was further stirred for about 30 minutes in a ball mill and the mixture, after removal of the solvent, was dried and crushed to disintegrate a slight agglomeration thereby to obtain a charge-imparting material according to the invention in the form of carrier particles.

Separately, 100 parts of polystyrene (Trade namei D-125, mfd. by Shell Chemical Co.) and 6 parts of carbon black (Trade name: Raven 3500, mfd. by Cabot Co.) were kneaded, crushed and classified to prepare a toner having sizes of 1–30 microns without adding a particular charge-imparting agent. This toner and the above mentioned carrier were mixed in a weight ratio of 10:100 to provide a developer. The triboelectric charge of the thus obtained developer was measured by the blow off method to be −8.8 μC/g.

The developer was used for imaging by means of a copying machine (NP-5000, mfd. by Canon K.K.). As a result, copied images were obtained with very little variation in image density, good reproducibility of thin line images and good gradation and without fog.

EXAMPLE 50

In 1 liter of xylene was dissolved 100 g of polymethyl methacrylate resin and further mixed with 50 g of Meta Complex Example (2). Into the solution thus obtained was dipped a developing sleeve (made of stainless steel) for a copier (NP-400RE, Canon K.K.), and the sovent was removed to form a coating film at a rate of 0.1 to 0.6 mg/cm$^2$. The thus coated sleeve was affixed to a developing apparatus for the copier (NP-400RE) and was used for a test explained hereinafter.

Separatey, the following ingredients were kneaded, crushed and classified to prepare a toner having particle sizes of 1 to 30 microns.

| | |
|---|---|
| Styrene/butyl methacrylate copolymer (Mw = 300,000) | 100 parts |
| Low-molecular weight polyethylene (Trade name: PE-130, mfd. by Hoechest A.G.) | 4 parts |
| Magnetite (Trade name: BL-200, mfd. by Titan Kogyo K.K.) | 60 parts |

The thus prepared toner was subjected to a successive imaging test by means of the above-mentioned deveoping apparatus provided with the coated sleeve. Images were obtained without change from the initial stage, with good reproducibiity of tnin lines and good gradation and with substantially no fog.

The surface potential on the sleeve was measured to be −41 V, and the toner was confirmed to be completely negatively charged.

EXAMPLE 51

Carrier particles were prepared in the same manner as in Example 49 except that Metal Complex Example (32) was used in place of Metal Complex Example (1), and used for imaging as in Example 49, whereby good results were obtained.

EXAMPLE 52

A coated sleeve was prepared in the same manner as in Example 50 except that Metal Complex Example (32) was used in place of Metal Complex Example (2), and used for imaging as in Example 50, whereby good results were obtained.

EXAMPLE 53

Carrier particles were prepared in the same manner as in Example 49 except that 4-isopropylhexahydroanthranilic acid nickel complex was used in place of Metal Complex Example (1), and used for imaging as in Example 49, whereby good results were obtained.

EXAMPLE 54

A coated sleeve was prepared in the same manner as in Example 50 except that hexahydroanthranilic acid nickel complex was used in place of Metal Complex Example (2), and used for imaging as in Example 50, whereby good results were obtained.

EXAMPLE 55

Carrier particles were prepared in the same manner as in Example 49 except that tris(glycinato)chromium (III) was used in place of Metal Complex Example (1), and used for imaging as in Example 49, whereby good results were obtained.

EXAMPLE 56

A coated sleeve was prepared in the same manner as in Example 50 except that tris(L-alaninato)cobalt (III) was used in place of Metal Complex Example (2), and used for imaging as in Example 50, whereby good results were obtained.

What is claimed is:

1. A positively chargeable dry toner for developing electrostatic latent images, comprising:

a binder resin, a colorant and a metal complex of an amino acid compound having an amino or monosubstituted amino group adapted to to complex with said metal, and a carboxyl group adapted to complex with said metal;

said metal complex comprising a complex of said amino acid compound and a divalent or trivalent metal atom selected from the group consisting of Ni, Co, Zn, Cd, Cu, Fe, Mn, Hg, Pb and Cr.

2. The toner according to claim 1, which comprises 0.1 to 20 parts by weight of the metal complex per 100 parts by weight of the binder resin.

3. The toner according to claim 1, wherein said metal complex comprises two or three molecules of an identical amino acid compound as ligands thereof.

4. The toner according to claim 1, wherein said metal complex comprises the amino acid compound as a ligand and also another compound as a ligand other than the amino acid compound.

5. The toner according to claim 1, wherein said metal complex is a chelate compound represented by the following formula (I):

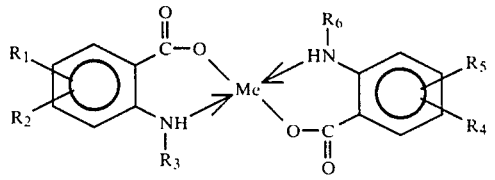

(I)

wherein $R_1$, $R_2$, $R_4$ and $R_5$ are the same or different groups selected from hydrogen, halogen, nitro, amino, substituted amino, alkyl ($C_1$–$C_{18}$), sulfamoyl, substituted sulfamoyl, or those groups which form a ring by a combination of $R_1$ and $R_2$ or $R_4$ and $R_5$; $R_3$and $R_6$ are the same or different groups selected from hydrogen, alkyl ($C_1$–$C_9$), benzyl, phenyl or substituted phenyl; and Me is a metal.

6. The toner according to claim 5, wherein the Me in the formula (I) is a divalent metal selected from the group consisting of Ni, Co, Zn, Cd, Cu, Fe, Mn, Hg and Pb.

7. The toner according to claim 1, wherein said amino acid compound is represented by the formula:

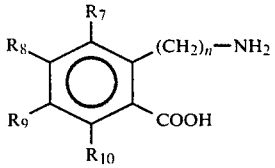

(II)

wherein $R_7$, $R_8$ and $R_9$ are respectively hydrogen or an alkyl and may be the same or different groups, and n is an integer of 1 to 3.

8. The toner according to claim 7, wherein said metal complex is a complex of a metal selected from the group consisting of Ni, Zn, Cr and Co.

9. The toner according to claim 7, wherein said alkyl has 1 to 9 carbon atoms.

10. The toner according to claim 1, wherein said amino acid compound is hexahydroanthranilic acid or an alkyl derivative thereof.

11. The toner according to claim 10, wherein said metal complex is a complex of a metal selected from the group consisting of Ni, Co, Zn and Cr.

12. The toner according to claim 1, wherein said amino acid compound is an aliphatic amino acid.

13. The toner according to claim 12, wherein said metal complex is a complex of a metal selected from the group consisting of Zn, Ni, Co and Cr.

14. A charge-imparting material for imparting charge to a developer for developing electrostatic latent images comprising a metal complex of an amino acid compound having an amino or mono-substituted amino group adapted complex with said metal and a carboxyl group adapted to complex with said metal, and a base material carrying the amino acid compound.

15. The charge-imparting material according to claim 14, wherein said metal complex is a chelate compound represented by the following formula (I):

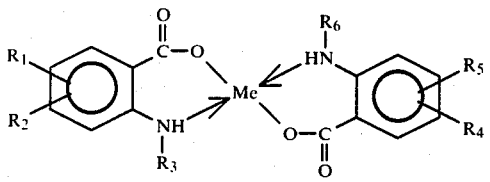

(I)

wherein $R_1$, $R_2$, $R_4$ and $R_5$ are the same or different groups selected from hydrogen, halogen, nitro, amino, substituted amino, alkyl ($C_1$–$C_{18}$), sulfamoyl, substituted sulfamoyl, or those groups which form a ring by a combination of $R_1$ and $R_2$ or $R_4$ and $R_5$; $R_3$ and $R_6$ are the same or different groups selected from hydrogen, alkyl ($C_1$–$C_9$), benzyl, phenyl or substituted phenyl; and Me is a metal.

16. The charge-imparting material according to claim 14, wherein said amino acid compound is represented by the formula:

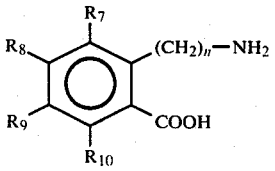

(II)

wherein $R_7$, $R_8$ and $R_9$ are respectively hydrogen or an alkyl and may be the same or different groups, and n is an integer of 1 to 3.

17. The charge-imparting material according to claim 16, wherein said metal complex is a complex of a metal selected from the group consisting of Ni, Zn, Cr and Co.

18. The charge-imparting material according to claim 16, wherein said alkyl has 1 to 9 carbon atoms.

19. The charge-imparting material according to claim 14, wherein said amino acid compound is hexahydroanthranilic acid or an alkyl derivative thereof.

20. The charge-imparting material according to claim 19, wherein said metal complex is a complex of a metal selected from the group consisting of Ni, Co, Zn and Cr.

21. The charge-imparting material according to claim 14, wherein said amino acid compound is an aliphatic amino acid.

22. The charge-imparting material according to claim 21, wherein said metal complex is a complex of a metal selected from the group consisting of Zn, Ni, Co and Cr.

23. The charge-imparting material according to claim 14, wherein said base material comprises magnetic particles, carrier particles, a sleeve or a doctor blade.

24. A triboelectrically chargeable composition comprising: a metal complex of an amino acid compound having an amino or mono-substituted amino group adapted to complex with said metal and a carboxyl group adapted to complex with said metal, and a base material carrying the metal complex.

25. The toner according to claim 1, wherein said binder resin is a styrene copolymer.

26. The toner according to claim 25, wherein said binder resin is a styrene copolymer selected from the group consisting of a styrene-acrylate copolymer, a styrene-methacrylate copolymer, a styrene-acrylate-monoalkyl maleate copolymer and a styrene-methacrylate-monoalkyl maleate copolymer.

27. The toner according to claim 8, wherein said metal complex comprises 2 or 3 mol parts of said amino acid compound and 1 atom. part of said metal.

28. The toner according to claim 11, wherein said metal complex comprises 2 mol parts of hexahydroanthranilic acid or an alkyl derivative thereof and 1 atom part of said metal.

29. The toner according to claim 13, wherein said metal complex comprises 3 mol parts of aliphatic amino acid and 1 atom part of said metal.

30. The toner according to claim 1, which is admixed with a silica having hydrophobicity and positive chargeability.

31. The toner according to claim 31, wherein said metal complex is a chelate compound represented by the following formula:

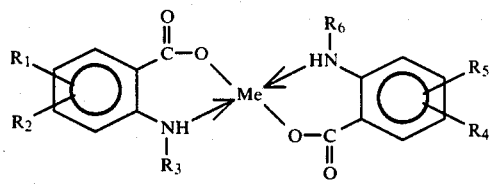

wherein $R_1$, $R_2$, $R_4$ and $R_5$ are the same or different and are selected from the group consisting of hydrogen, halogen, nitro, amino, substituted amino, alkyl ($C_1$–$C_{18}$), sulfamoyl, substituted sulfamoyl and those groups which form a ring by a combination of $R_1$ and $R_2$, or $R_4$ and $R_5$; and wherein $R_3$ and $R_6$ are the same or different and are selected from the group consisting of hydrogen, alkyl ($C_1$–$C_9$), benzyl, phenyl and substituted phenyl.

* * * * *

UNITED STATES PATENT AND TRADEMARK OFFICE

CERTIFICATE OF CORRECTION

PATENT NO. : 4,673,631

DATED : June 16, 1987

INVENTOR(S) : HIROSHI FUKUMOTO, ET AL.

It is certified that error appears in the above-identified patent and that said Letters Patent is hereby corrected as shown below:

AT [73] UNDER THE ASSIGNEE

Lines 1-2, "Canon Kabushiki Kaisha, Tokyo, Japan" should read --Canon Kabushiki Kaisha, Tokyo, Japan and Orient Chemical Industries, Ltd., Osaka-fu, Japan--.

COLUMN 18

Line 22, "(III)" should read --(III),--.

COLUMN 28

Line 34, "11.2" should read --+11.2--.

COLUMN 39

Line 66, "to to" should read --to--.

COLUMN 41

Line 8, "complex" should read --to complex--.

UNITED STATES PATENT AND TRADEMARK OFFICE

CERTIFICATE OF CORRECTION

PATENT NO. : 4,673,631

DATED : June 16, 1987

INVENTOR(S) : HIROSHI FUKUMOTO, ET AL.

It is certified that error appears in the above-identified patent and that said Letters Patent is hereby corrected as shown below:

COLUMN 42

Line 30, "atom" should read --atom.--.
Line 34, "atom" should read --atom.--.

Signed and Sealed this

Tenth Day of November, 1987

*Attest:*

*Attesting Officer*

DONALD J. QUIGG

*Commissioner of Patents and Trademarks*